US010947720B2

(12) United States Patent
Miller

(10) Patent No.: US 10,947,720 B2
(45) Date of Patent: Mar. 16, 2021

(54) BLOCK CONSTRUCTION OF PREFABRICATED BUILDINGS

(71) Applicant: RAD Urban Inc., Oakland, CA (US)

(72) Inventor: Randall Miller, Orinda, CA (US)

(73) Assignee: RAD URBAN, LLC, Walnut Creek, CA (US)

( * ) Notice: Subject to any disclaimer, the term of this patent is extended or adjusted under 35 U.S.C. 154(b) by 0 days.

(21) Appl. No.: 16/047,282

(22) Filed: Jul. 27, 2018

(65) Prior Publication Data

US 2019/0040623 A1 Feb. 7, 2019

Related U.S. Application Data

(60) Provisional application No. 62/537,713, filed on Jul. 27, 2017, provisional application No. 62/537,717, filed on Jul. 27, 2017.

(51) Int. Cl.

| | |
|---|---|
| ***E04B 1/34*** | (2006.01) |
| ***E04B 1/348*** | (2006.01) |
| ***E04G 21/14*** | (2006.01) |
| ***E04H 1/04*** | (2006.01) |
| ***E04H 1/00*** | (2006.01) |

(Continued)

(52) U.S. Cl.

CPC ..... *E04B 1/34861* (2013.01); *E04B 1/3483* (2013.01); *E04B 1/34815* (2013.01); *E04B 1/40* (2013.01); *E04B 2/88* (2013.01); *E04F 13/0855* (2013.01); *E04G 21/142* (2013.01); *E04H 1/00* (2013.01); *E04H 1/04* (2013.01);

(Continued)

(58) Field of Classification Search

CPC .... E04B 1/34861; E04B 2/88; E04B 1/34815; E04B 1/40; E04B 2001/405; E04F 13/0855

See application file for complete search history.

(56) References Cited

U.S. PATENT DOCUMENTS 1,362,069 A * 12/1920 Witzel ..... E04B 1/34815 52/745.03
2,037,895 A * 4/1936 Gugler ..... E04B 1/34869 137/357

(Continued)

FOREIGN PATENT DOCUMENTS

CN 204527557 U 8/2015
DE 19637549 C1 1/1998

(Continued)

OTHER PUBLICATIONS

International Search Report and Written Opinion in related International Application No. PCT/US2018/044142 dated Sep. 26, 2018.

(Continued)

*Primary Examiner* — Adriana Figueroa
(74) *Attorney, Agent, or Firm* — Foley & Lardner LLP

(57) ABSTRACT

Block construction of prefabricated buildings is disclosed. A building is constructed by the following steps. A plurality of structural units are assembled into a plurality of volumetric blocks. The structural units fabricated separately prior to assembly into the volumetric blocks. The volumetric blocks are assembled into a building frame. At least one non-structural module is inserted into the building frame. The non-structural module is affixed to one or more of the volumetric blocks.

20 Claims, 27 Drawing Sheets

(51) Int. Cl.

| | |
|---|---|
| ***E04B 1/41*** | (2006.01) |
| ***E04F 13/08*** | (2006.01) |
| ***E04B 2/88*** | (2006.01) |
| *E04B 1/38* | (2006.01) |

(52) U.S. Cl.
CPC ..... *E04B 2001/34892* (2013.01); *E04B 2001/405* (2013.01)

(56) References Cited

U.S. PATENT DOCUMENTS

| | | | | |
|---|---|---|---|---|
| 2,990,588 | A | 7/1961 | McKinley | |
| 3,077,960 | A | 2/1963 | Lang | |
| 3,447,503 | A | 6/1969 | Myers | |
| 3,500,595 | A * | 3/1970 | Bennett | E04B 1/3483 52/223.5 |
| 3,525,186 | A * | 8/1970 | Lombardo | E04H 6/18 414/255 |
| 3,541,744 | A * | 11/1970 | Maxwell | E04B 1/34807 52/73 |
| 3,638,380 | A | 2/1972 | Perri | |
| 3,712,008 | A | 1/1973 | Georgiev et al. | |
| 3,721,056 | A * | 3/1973 | Toan | E04B 1/20 52/236.6 |
| 3,742,660 | A | 7/1973 | Bierweiler | |
| 3,758,998 | A * | 9/1973 | Ollis | E04B 1/34807 52/745.03 |
| 3,805,461 | A | 4/1974 | Jagoda | |
| 3,823,520 | A * | 7/1974 | Ohta | E04B 1/24 52/73 |
| 3,882,649 | A | 5/1975 | Mah | |
| 3,894,373 | A | 7/1975 | Willingham | |
| 3,991,528 | A | 11/1976 | Dillon | |
| 4,050,215 | A * | 9/1977 | Fisher | E04B 1/34815 52/79.3 |
| 4,059,931 | A * | 11/1977 | Mongan | E04B 1/22 52/223.5 |
| 4,073,102 | A * | 2/1978 | Fisher | E04B 1/34823 52/223.4 |
| 4,102,097 | A * | 7/1978 | Zalotay | E04B 1/34807 52/167.4 |
| 4,194,339 | A * | 3/1980 | Fisher | E04B 1/34823 52/223.1 |
| 4,513,545 | A | 4/1985 | Hopkins, Jr. | |
| 4,525,975 | A | 7/1985 | McWethy | |
| 4,545,159 | A | 10/1985 | Rizk | |
| 4,723,381 | A * | 2/1988 | Straumsnes | E04B 1/34807 52/745.02 |
| 4,766,708 | A * | 8/1988 | Sing | E04B 1/98 248/585 |
| 5,233,808 | A * | 8/1993 | Salmenmaki | E04B 1/34807 52/234 |
| 5,400,550 | A | 3/1995 | Beasley | |
| 5,402,608 | A | 4/1995 | Chu | |
| 5,528,866 | A * | 6/1996 | Yulkowski | E04H 1/04 52/79.12 |
| 5,644,871 | A | 7/1997 | Cohen et al. | |
| 6,016,636 | A | 1/2000 | Caputo | |
| 6,493,996 | B1 * | 12/2002 | Alexander | E04B 1/34823 52/234 |
| 6,826,879 | B1 | 12/2004 | Allen et al. | |
| 6,925,761 | B1 * | 8/2005 | De La Marche | E04B 1/34815 52/220.1 |
| 7,047,897 | B2 | 5/2006 | Eloranta et al. | |
| 7,827,738 | B2 * | 11/2010 | Abrams | E04B 1/003 52/79.1 |
| 7,921,609 | B2 | 4/2011 | Kordelin | |
| 8,082,699 | B1 * | 12/2011 | Kychelhahn | E04B 1/6116 52/295 |
| 8,166,714 | B2 | 5/2012 | Ziegelman | |
| 8,276,328 | B2 * | 10/2012 | Pepin | E04B 1/3483 52/167.3 |
| 8,621,787 | B2 | 1/2014 | Barry et al. | |
| 9,068,340 | B2 * | 6/2015 | Austin | E04B 1/35 |
| 9,556,632 | B2 * | 1/2017 | Malakauskas | E04B 1/34869 |
| 9,663,937 | B2 * | 5/2017 | Goldman | E04B 1/3483 |
| 9,745,764 | B2 * | 8/2017 | Fisher | E04H 1/005 |
| 10,538,388 | B2 * | 1/2020 | Clarke | B65G 1/0478 |
| 2003/0041555 | A1 | 3/2003 | Scallan et al. | |
| 2003/0101680 | A1 * | 6/2003 | Lee | E04H 1/04 52/745.2 |
| 2003/0136062 | A1 | 7/2003 | Gunthardt | |
| 2007/0144079 | A1 * | 6/2007 | Hourihan | E04B 1/34807 52/79.1 |
| 2007/0271857 | A1 * | 11/2007 | Heather | B65D 88/005 52/79.9 |
| 2008/0134589 | A1 | 6/2008 | Abrams et al. | |
| 2010/0058675 | A1 * | 3/2010 | Simmons | E04B 1/34807 52/79.1 |
| 2010/0107517 | A1 | 5/2010 | Smith | |
| 2012/0240482 | A1 | 9/2012 | Pitt et al. | |
| 2013/0305629 | A1 | 11/2013 | Stephenson et al. | |
| 2014/0123573 | A1 | 5/2014 | Farnsworth | |
| 2016/0002909 | A1 | 1/2016 | Bowron et al. | |
| 2016/0122997 | A1 * | 5/2016 | Smith | E04B 1/34807 52/79.12 |
| 2016/0312485 | A1 * | 10/2016 | Wilson | E04H 1/005 |
| 2017/0089060 | A1 | 3/2017 | Harper | |

FOREIGN PATENT DOCUMENTS

| | | | |
|---|---|---|---|
| DE | 102004048610 | A1 | 4/2006 |
| WO | 2011117675 | A1 | 9/2011 |

OTHER PUBLICATIONS

International Search Report and Written Opinion in related International Application No. PCT/US2018/044131 dated Sep. 26, 2018.
Deltec Homes, Prefab vs. Modular vs. Panelized, as viewed on Jul. 25, 2018. "https://www.deltechomes.com/prefab-vs-modular-vs-panelized/".
TC MAXIs, Prefabricated Cabin Unit System, as viewed on Jul. 25, 2018. "http://www.tcmaxis.com/wp-content/uploads/2011/04/Staco-Prefabricated-Cabins.pdf".

* cited by examiner

BLOCK CONSTRUCTION OF PREFABRICATED BUILDINGS

CROSS-REFERENCE TO RELATED APPLICATIONS

This application claims priority to U.S. Provisional Patent Application No. 62/537,717, filed on Jul. 27, 2017 and to U.S. Provisional Patent Application No. 62/537,713, filed on Jul. 27, 2017, the entire contents of each of which are hereby incorporated by reference.

FIELD OF THE INVENTION

The present invention relates to volumetric blocks and methods for building modular buildings from volumetric blocks.

BACKGROUND OF THE INVENTION

Traditional modular construction approaches use centralized manufacturing facilities, which manufacture modular building components. These modules are then transported to an assembly site, stacked together, and connected to construct a building. Construction companies typically employ one of two approaches for developing modular buildings: volumetric modules and flat panel (flat pack) modules. Volumetric modules may be complete with finishes for walls, floors, ceilings and furniture that are produced in the factory, shipped, and assembled on site. Flat panel (flat-pack) modules may include individual components of modules that are shipped in "flat panel" boxes and then assembled on site to construct a building. Typical modular construction techniques suffer drawbacks including limitations on the types of construction, transportation costs, scaling limitations, temperature and waterproofing limitations, limits to prefabrication and other shortcomings.

BRIEF SUMMARY OF THE INVENTION

An embodiment includes a method for building a modular building including assembling a plurality of structural units into a plurality of volumetric blocks. The structural units may be fabricated separately prior to assembly into the volumetric blocks. The volumetric blocks are assembled into a building frame. At least one non-structural module is inserted into the building frame. The non-structural module is affixed to one or more of the volumetric blocks.

An embodiment includes a volumetric block for a modular building having a plurality of non-volumetric structural units, a facade component, and a core system component. At least one of the plurality of non-volumetric structural units is configured to adjustably attach the facade component, at least one of the plurality of non-volumetric structural units is configured to interface with the core system component, and the plurality of non-volumetric structural units are configured to interface with a non-structural module.

An embodiment includes a modular building. The modular building includes a plurality of foundation blocks, a plurality of core blocks, a plurality of deck blocks, and a plurality of non-structural modules. The non-structural modules are configured to be affixed to one or more of the deck blocks during assembly of the modular building.

DESCRIPTION OF THE FIGURES

Exemplary embodiments of the invention will be now described in greater detail below with reference to the accompanying drawings, in which.

DETAILED DESCRIPTION OF THE INVENTION

Figure 1:
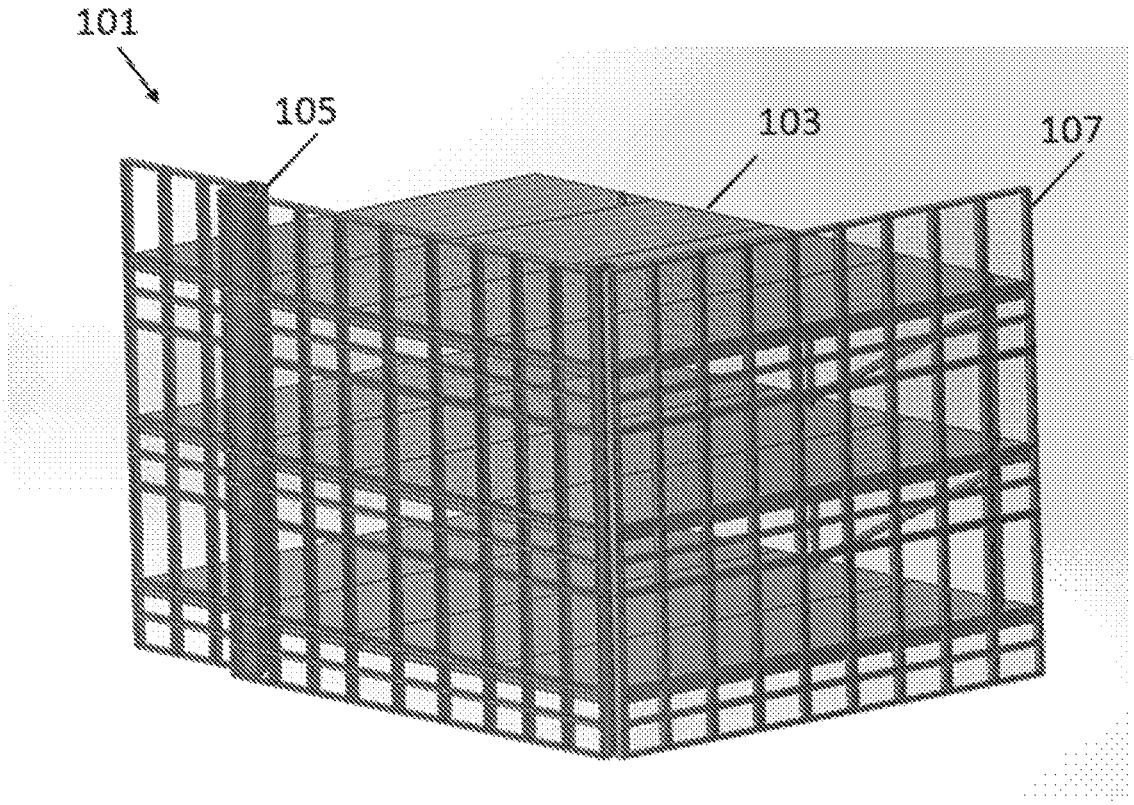
FIG. 1 depicts an exemplary deck volumetric block according to various embodiments.

Some embodiments of the current invention are discussed in detail below. In describing the embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections are incorporated as if each had been individually incorporated.

As used throughout, the term "non-structural module" refers to a volumetric module or manufactured space that can be contained within a structural unit, a volumetric block, a building frame and/or modular building in general. As opposed to a structural unit or module, a non-structural module is not integral to the structural support systems of a building. A non-limiting example of a non-structural module would be an accommodation module in a residential building, where the accommodation module generally refers to a space or room for habitation, such as a kitchen, bedroom, living room, and/or other room. In another example, an accommodation module may include a configurable building space such as an office space, conference room, cafeteria, hospital room, hotel room, and the like. In certain cases, the approximate dimensions of an accommodation module may range between 11 feet by 30 feet to 13.5 feet by 30 feet. The aforementioned dimensions are examples only.

As used throughout herein, the terms "structural unit" and "non-volumetric structural unit" may be used interchangeably and refer to a non-volumetric linear or planar component, which provides structural support for a building frame or building. In accordance with an exemplary embodiment, a plurality of structural units are assembled to form one or more volumetric blocks. The volumetric blocks are assembled at a job site into a building frame. As a result, the structural units form at least part of a building's structural system. In certain cases, the structural units form a building's entire structural system. Non-limiting examples of structural units include the individual components for a deck, a wall, a column, a stair, and the like. etc. Non-limiting examples of structural units may also include an entire deck unit, a wall unit, a column unit, and/or a stair unit. Additionally, in embodiments of the invention, at least some structural units in a building are configured to interface with a non-structural module. In some embodiments, a structural unit consists of a stiffened steel plate chassis with 6 inch steel stiffeners, which forms the diaphragm for the structural system along with columns which transfer load down to the ground.

As used throughout, the term "core system component" refers to a building's mechanical, electrical, plumbing and/or heating, ventilation and air-conditioning (HVAC) systems as well as one or more of the individual components which make up these systems. The term can also refer to any other system vital or important for the day-to-day operations of a building. In certain cases, core system components may include engineering systems in a module that allow a building to perform its function (e.g., structural integrity) and provide comfort to occupants in terms of heating, cooling, ventilation, hot water, cold water, electricity for all purpose, sewage and waste disposal.

As used throughout, the terms "volumetric block," "modular volumetric block," "structural block," and "block" are used interchangeably. A block may be assembled from structural units, façade components, core system components, and/or other elements.

Disclosed herein are techniques of building modular buildings. The techniques disclosed herein may be referred to as the "block construction method" (e.g., block construction techniques). The block construction techniques disclosed herein overcome the following disadvantages associated with typical modular construction approaches. In traditional volumetric modules and flat panel (flat-pack) modules, the size of modules could be limited by restraints on the mode of transport (e.g., truck or ship cargo capacity). For example, the mode of transport limits structural member sizes, and ultimately the height of buildings that can be built using a centralized facility. Also, module weights have to be carefully managed and any extra weight adds significant transportation costs.

Transportation costs may become dominant costs as the distance to the site from the factory increases, thereby eroding any cost advantages compared to traditional site built construction. In certain cases, scaling may be capital and resource intensive, since new plants need to be located and built such that demand in that region can be met without increasing transportation costs significantly.

Assembly may also rely on risky, costly, and slow temporary waterproofing solutions. These temporary waterproofing systems offset cost and schedule savings otherwise achieved by prefabrication. Additionally, a failure in the temporary waterproofing potentially exposes the project to significant water damage losses.

In tall building construction, traditional volumetric modules remove no more than 50% of building construction costs to a manufacturing environment. At least 50% remains traditional on-site construction susceptible to subcontractor labor shortages, and all of the issues and challenges of traditional construction methods. The 50% constructed on site by traditional means does not benefit from advanced manufacturing economies and tends to offset savings achieved from the use of manufactured volumetric modules. The complexities of connecting high precision manufactured products to crudely (by relative comparison) site-built components adds otherwise unnecessary cost and time.

The block construction techniques disclosed herein overcome these shortcomings and provide other advantages. The block construction techniques disclosed herein transform the manner in which dwellings (e.g., single family houses, multifamily apartments), commercial buildings, high-rises, and/or other buildings are fabricated resulting in reductions in cost and schedule.

In various embodiments, a block construction method is divided into several sub-processes including one or more of the following: (1) non-structural module fabrication (e.g., prefabrication in a factory), (2) structural unit fabrication and outfitting, (3) façade manufacturing, (4) block assembly at a location proximate to the build site, and (5) assembly of the building from blocks and non-structural modules at the building site.

In certain cases, a first portion of the process includes non-structural module fabrication (e.g., factory prefabrication). Prefabricated non-structural modules, such as accommodation modules, may be built in the prefabrication factory. For example, at this plant, bedroom components, bathroom components, living room components, kitchen components, office components, lobby components, entertainment room components, audio and visual components, server room components, and/or other non-structural office and living components are formed into accommodation modules that are assembled in a multiple station (e.g., 40 station) assembly line. Using these techniques, multiple accommodation modules can be produced in a day. For example, production rates of at least 12 accommodation modules of up to 560 square-feet per day can be achieved. In certain cases, the accommodation modules are sound-rated and fire-rated while avoiding gypsum board assemblies. The accommodation modules can be manufactured to be substantially pre-finished with components including but not limited to wall coverings, cabinets, countertops, desks, fixtures, appliances, audio visual equipment, server components, and the like. Accommodation modules can be shipped by conventional flatbed truck ready to interface with structural blocks in a plug and play fashion within a building formed from block construction. Once the structural blocks are assembled into a building frame and the accommodation modules are installed, the only areas remaining are the common area finishes and commissioning.

In an exemplary embodiment, the structural units that are assembled to form structural blocks are manufactured by steel unit fabricators and/or outfitting shops located outside of an urban or populated area where a build site is located. The size and weight of structural blocks are not always limited. However, in densely populated and industrialized cities where streets are obstructed and building sites are difficult to reach, the weight and size of structural blocks is specifically limited for urban use. In an exemplary embodiment, structural blocks may weigh up to 66 tons with dimensions of up to 45 feet in width, 40 feet in length, and 30 feet in height to accommodate obstructed approach paths and building sites located in urban areas.

In various embodiments, façade components are manufactured and façade manufacturer, which may be independent from the structural unit manufacturer. The façade units are then transported to the block assembly yard for installation in a block. In certain cases, structural blocks can have their exterior facades in place, as well as fire-proofing, insulation, core building systems, weather tight decks, and/or other features. Such features are incorporated into the structural units at the steel unit fabrication site and/or the outfitting shop.

In an exemplary embodiment, the structural blocks are assembled, for example, in a block assembly yard. The block assembly yard may include an enclosed production environment near the jobsite. Depending on the proximity to the build site, assembled structural blocks can be transported to the jobsite for building erection using flat-bed trucks, cranes located at or near the build and assembly site, or similar transport trucks or machines.

In an exemplary embodiment of the block construction method, a building is composed of structural blocks weighing 66 tons or less and with dimensions of approximately 45 feet in width, 40 feet in length, and 30 feet in height or smaller. In one example, a 30-story residential tower with 300 units may consist of 110 blocks with an assembly rate of one block per day. In this case, the tower is topped out with the structure complete, weathertight skin, and core systems in-place in under six months. The block construction method can be implemented in any location where a block assembly yard is set up and block transport logistics are available.

In various embodiments, blocks are assembled from flatbed transportable standardized structural units that have been outfitted as required at an outfitting shop. At the outfitting shop, technicians may paint, wire, plumb, fireproof, insulate and otherwise pre-process pre-fabricated steel units or facade units as required. Through this process, the entire building structure, facade, and core systems (fire sprinklers, plumbing, electrical, and/or HVAC etc.) are produced in an advanced manufacturing environment. This is in contrast with the traditional solutions, where scores of tradesmen work hundreds of feet in the air on one-off problems in essentially unsupervised and highly exposed conditions. In some embodiments according to the invention, the block manufacturing methods disclosed result in a 45% cost reduction, a 50% time savings, better safety, better quality, and other benefits over traditional systems.

In various embodiments, production facilities described herein operate using advanced LEAN manufacturing techniques with moving assembly lines, paperless manufacturing data and quality control systems, data-driven process improvement, and automation.

In various embodiments, the techniques disclosed herein may be used in the fabrication of volumetric modular buildings and high-rises, multi-family modular buildings, single family modular buildings, structural connections, structural framing for buildings, and the like.

An exemplary method for building a modular building includes assembling a plurality of structural units into a plurality of volumetric blocks. The structural units may be fabricated separately prior to assembly into the volumetric blocks. The volumetric blocks are assembled into a building frame. At least one non-structural module is inserted into the building frame. The non-structural module is affixed to one or more of the volumetric blocks.

In accordance with an exemplary method for building a modular building, the non-structural module is affixed to a core volumetric block.

In accordance with an exemplary method for building a modular building, the non-structural module is moved into place within the building frame and affixed to the volumetric block.

In accordance with an exemplary method for building a modular building, non-structural modules are fabricated using multiple station assembly line.

In accordance with an exemplary method for building a modular building, the non-structural modules comprise one or more of kitchen accommodation module, a bedroom accommodation module, and a living room accommodation module.

In accordance with an exemplary method for building a modular building, the volumetric blocks include a deck block, a core block, and/or a foundation block.

In accordance with an exemplary method for building a modular building, a volumetric block include a core block comprising at least one column, at least one structural deck unit, and at least one stair unit.

In accordance with an exemplary method for building a modular building, the non-structural modules include a wall covering, a cabinet, a countertop, a fixture, an appliance, a plumbing fixture, mechanical equipment, and/or distribution equipment.

In accordance with an exemplary method for building a modular building, the non-structural modules further include at least one of sound-rating and fire-rating at least one of the plurality of non-structural modules. In certain cases, the fire-rating may include ASTM E119 fire rating for our accommodation modules, and the sound-rating may include STC 65 sound rating.

In accordance with an exemplary method for building a modular building, the structural units are fabricated at a structural unit fabrication site separate from the site where the blocks are assembled.

In accordance with an exemplary method for building a modular building, fabricating the structural units includes painting, sound-rating, fire-rating, insulating, electrical wiring, incorporating a duct, and incorporating one or more plumbing features into at least one of said plurality of structural units.

In accordance with an exemplary method for building a modular building, the structural units include a core system component, the core system component including one or more of a mechanical system, an electrical system, and a plumbing system.

In accordance with an exemplary method for building a modular building, the structural units comprise at least one of a sprinkler, a valve, a sensor, a switch, piping, valves, fittings, and distribution system components.

In accordance with an exemplary block for building a modular building, the plurality of structural units includes one or more of a deck unit, a wall unit, a column unit, a stair unit, foundation blocks, columns, beams, brace frames, walls, columns, shear walls, steel plate decks, and reinforcement structures.

In accordance with an exemplary method for building a modular building, assembling the plurality of structural units into a plurality of volumetric blocks occurs in a block assembly yard.

In accordance with an exemplary method for building a modular building, assembling the plurality of structural units into a plurality of volumetric blocks further includes completing an electrical connection between the assembled structural modules, or completing a plumbing connection between the assembled structural modules.

In accordance with an exemplary method for building a modular building, fabricating a plurality of non-structural modules occurs at a first location, fabricating a plurality of structural units occurs at a second location, and assembling the plurality of structural units into a plurality of volumetric blocks occurs at a third location, and assembling the plurality of volumetric blocks into a building frame occurs at a fourth location. The first location, the second location, the third location and the fourth location are different from one another.

In accordance with an exemplary method for building a modular building, fabricating the plurality of non-structural modules occurs at a module accommodation factory.

In accordance with an exemplary block for building a modular building, each of the plurality of structural units has a dimension of about 7 to about 14 feet in width, by about 25 to about 50 feet in length, by about 7 to about 15 feet in height.

In accordance with an exemplary method for building a modular building, incorporating a core system component into at least one of the plurality of structural units includes incorporating at least one system selected from the group consisting of a mechanical system, an electrical system, and a plumbing system.

In accordance with an exemplary method for building a modular building, outfitting occurs at an outfitting shop.

In accordance with an exemplary method for building a modular building, fabricating the plurality of structural units further includes at least one of painting, sound-rating, fire-rating, insulating, electrical wiring, incorporating a duct, and incorporating one or more plumbing features into at least one of said plurality of structural units.

In accordance with an exemplary method for building a modular building, an outfitting shop completes the painting, sound-rating, fire-rating, insulating, electrical wiring, and incorporates a duct and one or more plumbing features into the structural units.

In accordance with an exemplary method for building a modular building, the block assembly yard includes a hoisting apparatus with at least four hoists.

In accordance with an exemplary method for building a modular building, the block assembly yard has a dimension of about 25 to about 50 feet in width by about 75 to about 150 feet in length.

In accordance with an exemplary block for a modular building, each of the plurality of volumetric blocks has a dimension of about 20 to about 45 feet in width, about 20 to about 40 feet in length, and about 15 to about 30 feet in height.

An exemplary method for building a modular building includes fabricating a plurality of non-structural modules, fabricating a plurality of structural units, assembling the plurality of structural units into a plurality of volumetric blocks, assembling the plurality of volumetric blocks into a building frame, and incorporating at least one of the plurality of non-structural modules into the building frame. In such an embodiment, the fabricating of the plurality of non-structural modules includes use of a multiple station assembly line. The fabricating a plurality of structural units includes adjustably attaching a facade component to at least one of the plurality of structural units, and incorporating a core system component into at least one of the plurality of structural units. In such an embodiment, at least a portion of the plurality of volumetric blocks is configured to interface with at least one of the plurality of non-structural modules.

In accordance with an exemplary volumetric block for a modular building, a volumetric block includes a plurality of non-volumetric structural units, a facade component, and a core system component. In such an embodiment, the facade component is configured to adjustably attach to at least one of the plurality of structural units. At least one of the plurality of non-volumetric structural units is configured to interface with the core system component. The plurality of non-volumetric structural units are configured to interface with a non-structural module.

In accordance with an exemplary block for a modular building, the plurality of non-volumetric structural unit comprise one or more of a deck unit, a wall unit, a column unit, and a stair unit.

In accordance with an exemplary block for a modular building, the core system component is selected from the group consisting of a mechanical system, an electrical system, and a plumbing system.

In accordance with an exemplary block for a modular building, the facade includes a curtain wall system.

An exemplary modular building includes a plurality of foundation blocks, a plurality of core blocks, a plurality of deck blocks, and a plurality of non-structural modules, the non-structural modules affixed to one or more of the deck blocks during assembly of the modular building.

A non-limiting example embodiment of the present invention relates to a process of building modular buildings, called the "Block construction method." A "block" (e.g., volumetric block) for the block construction method is defined as the "unit" of construction in a building. Each block is made up of sub-assemblies/sub-blocks. Sub-assemblies/sub-blocks that form each block may include, but are not limited to, structural units or elements, such as a structural deck component, structural wall component, a structural column component or a structural stair component, a core Mechanical, Electrical or Plumbing (MEP) system, a facade, such as a curtain wall system, and/or other elements.

FIG. 1 depicts an exemplary deck volumetric block according to various embodiments. In the example shown, block 101 includes a plurality of structural units (e.g., non-volumetric structural units) such as structural deck components 103, structural column components 105, and structural wall components 107. The plurality of non-volumetric structural units are configured to interface with a non-structural module. In certain cases, structural wall components 107 may be attached to a façade system.

Figure 2:
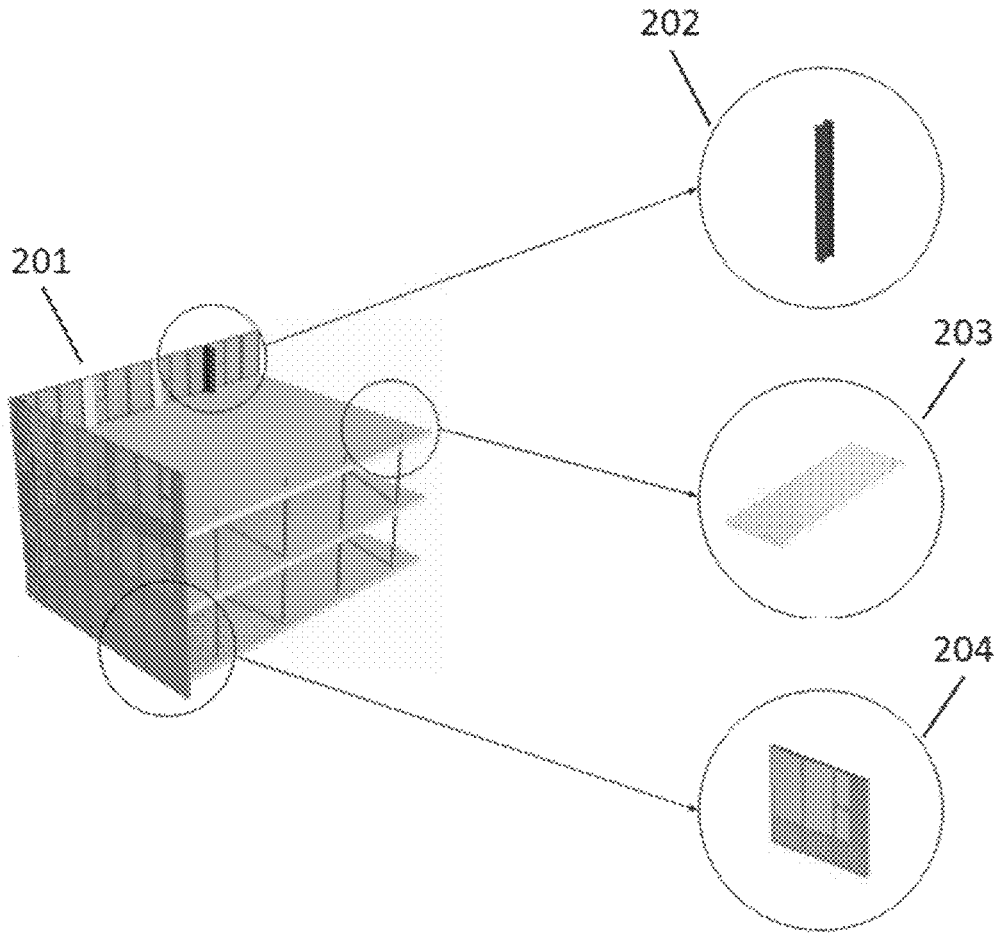
FIG. 2 is a diagram depicting assembly of an exemplary deck block according to various embodiments.

FIG. 2 is a diagram depicting assembly of an exemplary deck block according to various embodiments. In the example shown, a deck block 201 includes columns 202, deck units 203, curtainwall units 204, and/or other components. The curtain wall units 204 may be adjustably attached to the column 202 and/or structural wall components (not shown). A curtainwall unit may include metallic sheets (e.g., aluminum mullions), glass panel, and/or other components. The curtainwall units 204 shown are just one possible façade. It certain cases, any alternate façade system (such as metallic panel curtain wall) may be used.

Figure 3:
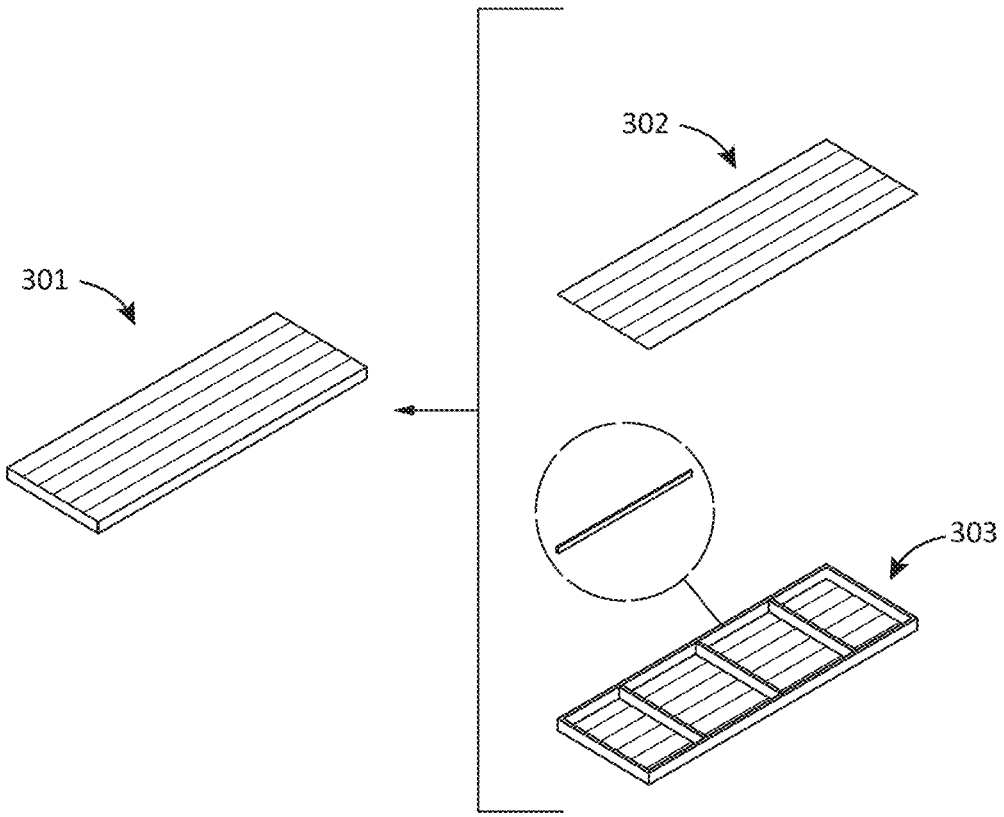
FIG. 3 is a diagram depicting assembly of a deck unit according to some embodiments.

FIG. 3 is a diagram depicting assembly of a deck unit according to some embodiments. In the example shown, a deck unit 301 (e.g., deck unit 203 of FIG. 2) may include a metal plate 302 welded with stiffeners 303. The deck unit 301 forms the floor structure in a deck block (e.g., deck block 201 if FIG. 2). Multiple deck units 301 may be attached together (e.g., welded, screwed, etc.) to form a deck block. In certain cases, the deck units 301 are fabricated at a unit outfitting facility as discussed herein.

Figure 4:
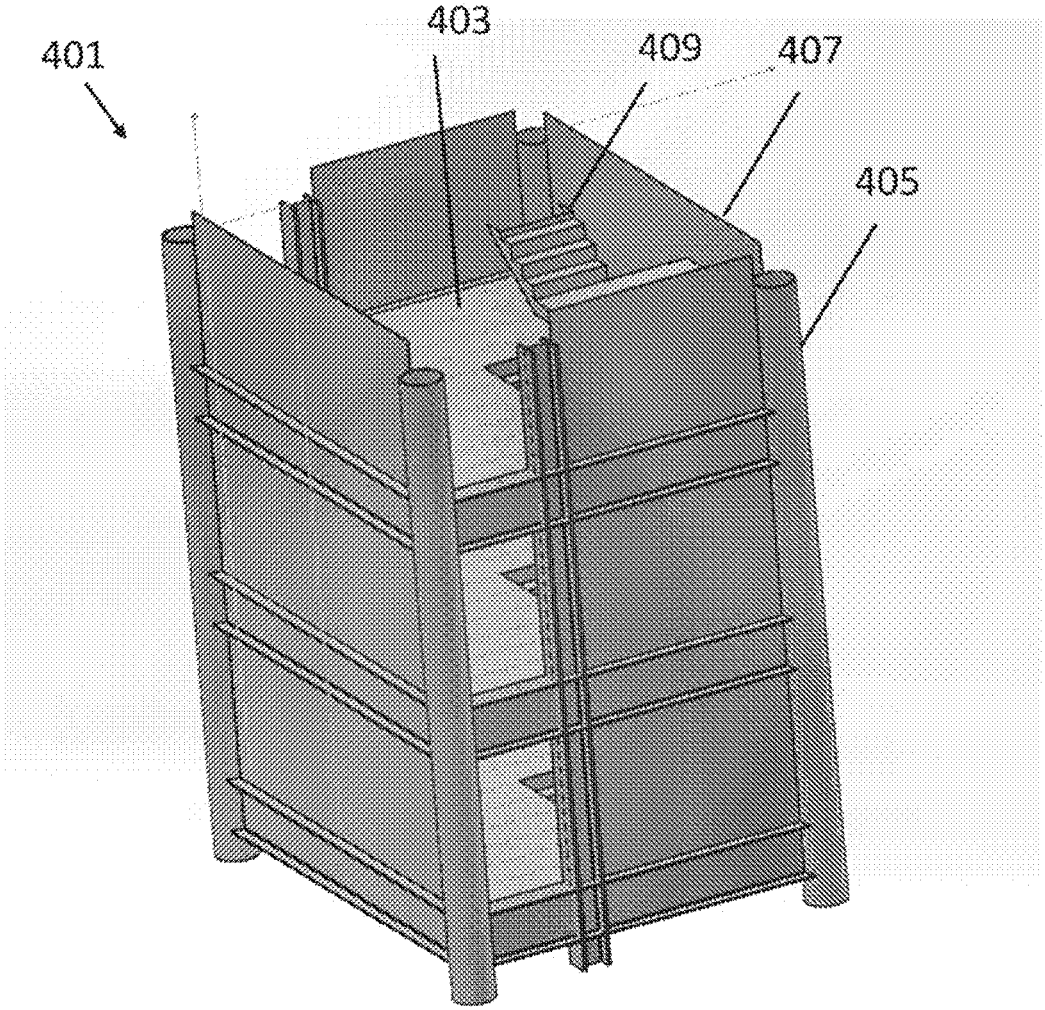
FIG. 4 depicts an exemplary core volumetric block according to various embodiments.

FIG. 4 depicts an exemplary core volumetric block according to various embodiments. In the example shown, a block 401 includes a plurality of non-volumetric structural units such as structural deck components 403, structural column components 405, structural wall components 407, and/or structural stair components 409. The plurality of non-volumetric structural units are configured to, for example, provide structural stability for a building, interface with core system components, and interface with non-structural modules. The core block 401 may be located near a center of the building.

Figure 5:
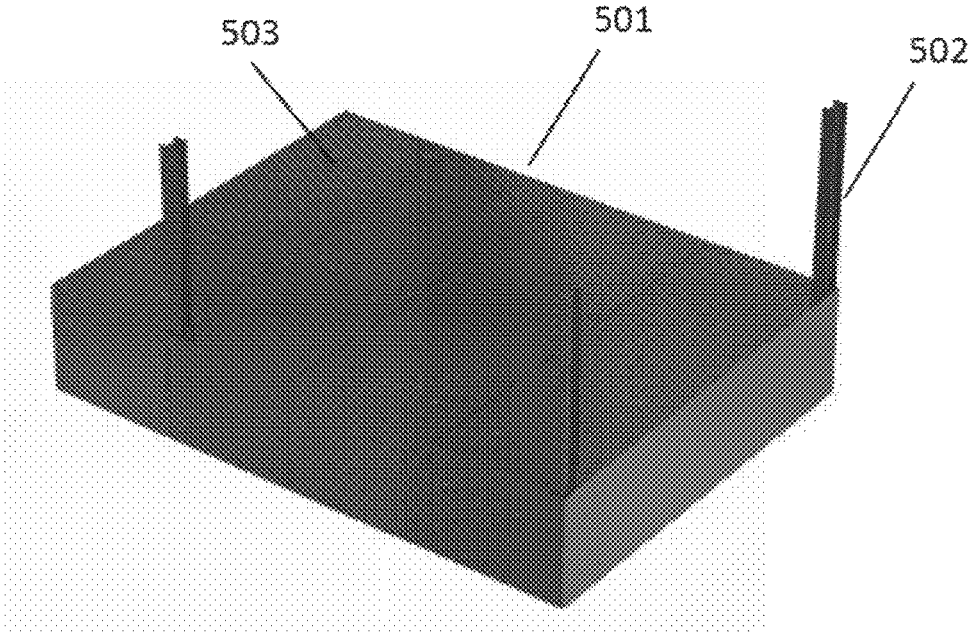
FIG. 5 depicts an exemplary foundation block according to an embodiment.

FIG. 5 depicts an exemplary foundation block according to an embodiment. In the example shown, a foundation block 501 includes multiple columns 502 attached to a base structure 503. Multiple foundation blocks 501 may form the foundation of a building structure. Foundation blocks 501 may attached to other foundation blocks, core blocks 401, and/or deck blocks 201 to form the structure of a building.

Figure 6:
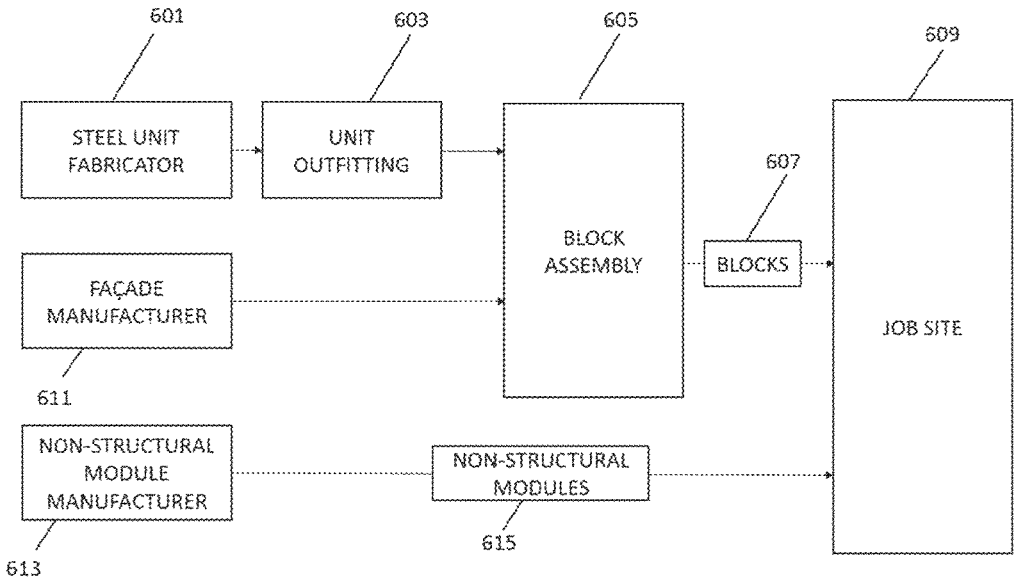
FIG. 6 is a flow diagram detailing an exemplary block construction method according to various embodiments.

FIG. 6 is a flow diagram detailing an exemplary block construction method according to various embodiments. As shown FIG. 6, the block construction method is divided into sub-processors and corresponding process locations including one or more of the following: 1) the steel unit fabricator 601; 2) the outfitting facility 603; 3) façade manufacturing facility 611, 4) the block assembly yard 605; 5) the non-structural module manufacturer 613; and 6) the jobsite or building erection site 609. A brief discussion of these sub-processes follows.

1) Steel Unit Fabricators:

Steel unit fabricators 601 can provide non-volumetric structural units (e.g. steel units) in sizes transportable by normal means (e.g. a flatbed truck). The blocks are assembled from these steel units. The sections of steel provided by these fabricators can be a maximum of 10-14 feet by 30-50 feet by 10-15 feet (which is approaching the practical maximum allowable size for transportation). Steel units can include deck sections, column sections, shear-wall sections, brace-frame sections, moment-frame sections, stair sections, foundation sections, and the like.

2) Outfitting Shops:

At the outfitting shop 603, the steel units are prepared for their use in the building and "outfitted" with as much of the finished building elements as possible at this stage, excluding accommodations, which are included with the accommodation module. Steel units are painted, insulated, fireproofed, wired, plumbed, ducted, and have devices installed such as valves, switches, sensors, etc. at this shop. All elements, except accommodations, in the finished building are installed at the outfitting shop unless such elements are precluded from installation at this stage because of constraints such as transportation and erection.

3) Façade Manufacturing Facility:

A façade manufacturing facility 611 assembles curtainwall systems and/or other types of facades. In the case of the curtainwall system, the façade manufacturing facility may assemble metallic sheets (e.g., aluminum mullions), glass panel, and/or other components to fabricate a curtain wall system. An assembled curtainwall system may be transported to the block assembly yard 605.

4) Block Assembly Yard:

The block assembly yard 605 assembles the volumetric blocks 607. The block assembly yard may receive units (e.g., deck units, stair units, structural units) from the unit outfitting shop 603. The block assembly yard 605 may also receive façade components from the façade manufacturer 611. Blocks 607 are assembled from the units and/or façade components as described herein. In certain cases, blocks 607 are fabricated to be of a maximum weight that can be hoisted by a jobsite tower crane or transported via flatbed truck or similar means. For example, blocks that are a maximum weight of 60-1000 tons and of a specific maximum dimension are used to conform to the physical constraints of the block yard and transportation routes to the build site. The block assembly yard 605 is preferably located in close proximity to the building site 609. If the block yard is not located adjacent or within the jobsite, a city street may be used to route blocks to the build site. Even with special permits, special transport equipment, and use of off-hours, modern urban environments are limited in space, filled with obstructions, and exhibit irregular geometries. To accommodate the most obstructed and irregular cities, city layouts and building site routes, an exemplary block has maximum dimensions of up to 30 feet in width, 30 feet in length, and 30 feet in height. These exemplary dimensions correspond to the maximum width of the surface streets in the city and maximum height of underpasses in many typical cities.

At the block assembly yard 605, blocks may be manufactured using linear and planar structural units (e.g., steel units) including but not limited to decks, columns, stair cases, walls, lateral elements, shearwalls, brace frames, moment frames and component parts thereof. Outfitted steel units are connected to form the block. For example, structural joints are completed and steel units are connected by welding or bolting the joints. Paint, insulation, and fireproofing is patched at the unit joints or completed. The exterior facade is installed on the outside of the block.

At the block assembly yard 605, electrical connections, mechanical connections, plumbing connections, HVAC connections, and other core system components found within structural units are connected between adjacent structural steel units forming a block. In most cases, primary components of core mechanical, electrical and plumbing systems and equipment are installed at this time. This provides significant time, money, and labor savings relative to traditional solutions where scores of tradesmen work hundreds of feet in the air on one-off problems in essentially unsupervised and highly exposed conditions. The exemplary embodiments of modular block construction disclosed herein have an advantage of 45% cost reduction, 50% time savings, better safety, and better quality.

The blocks 607 are assembled in a block assembly yard 605, which is an enclosed production environment at or near the building site. The blocks are assembled from flatbed transportable standardized units that have been outfitted at an outfitting shop. At the outfitting shop, painting, electrical wiring, plumbing, fire-proofing, insulation and other preprocessing is conducted on the pre-fabricated steel units or facade units that are received from supply chain partners.

A finished block 607 embodies the structure, facade, weatherproofing, paint, insulation, fireproofing, and core MEP systems of the section of the building that the block provides. These features are prefabricated onto the structural units at the steel unit fabricator and/or outfitting shop such that finished structural units are provided to the block assembly yard and further assembled into blocks.

In various embodiments, blocks 607 may be assembled by joining two or more sub-blocks together. Sub-blocks can be adjoined and assembled in accordance with systems and methods disclosed in Applicant's co-pending U.S. application Ser. No. 16/047,291, filed on the same date as the present application and titled "PREFABRICATED MODULAR BUILDINGS," which is incorporated in its entirety herein by reference. The top deck of the block 607 may be made weather proof during block assembly following connection of one sub-block to an adjacent sub-block. Similarly, the exterior facade of the block is made weather tight during block assembly following connection of one block to an adjacent block during assembly of the building frame.

Figure 7:
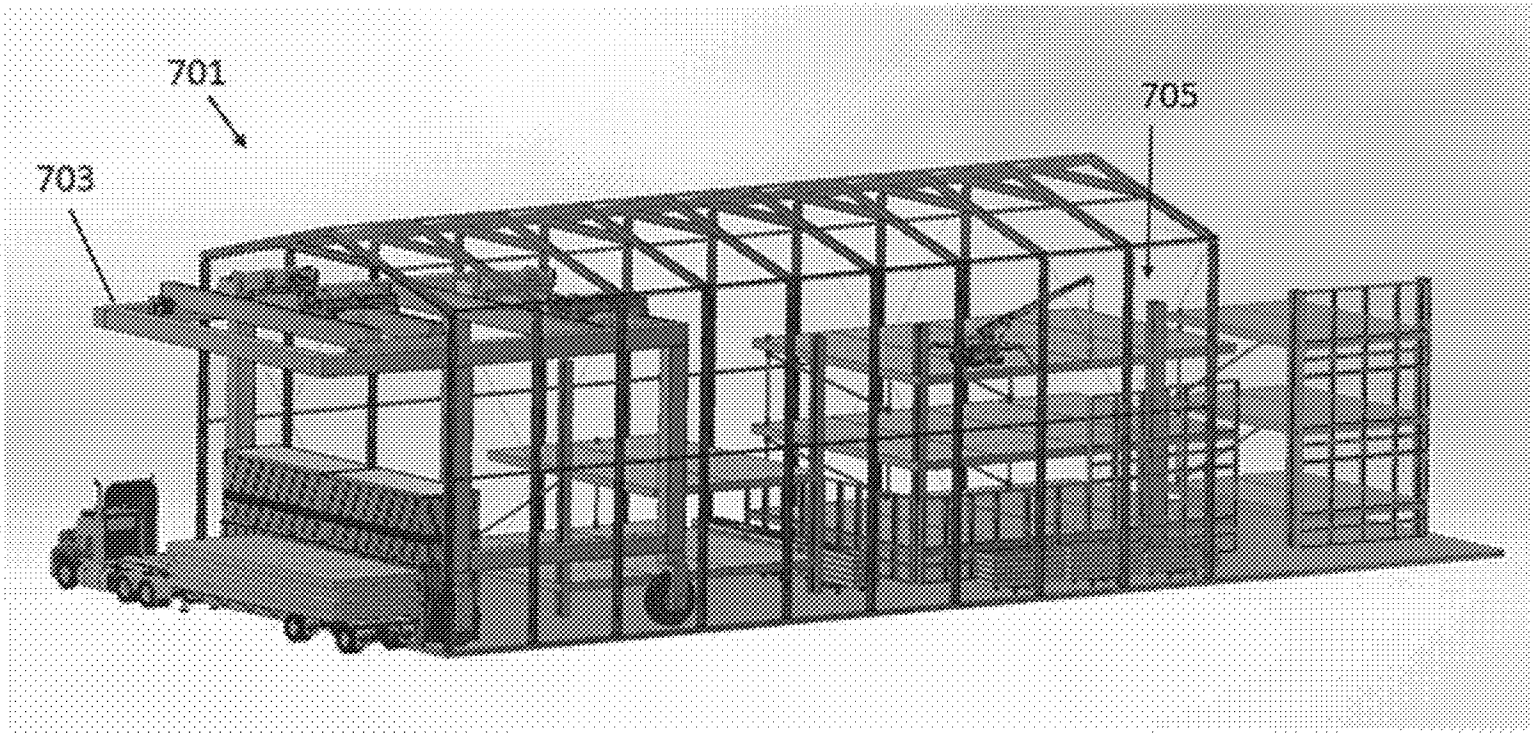
FIG. 7 is a schematic of block assembly yard according to various embodiments.

FIG. 7 is a schematic of block assembly yard according to various embodiments. In the example shown, an exemplary block assembly yard 701 includes a gantry crane 703 (or other hoisting apparatus), which unloads the linear and planar steel deck units, column units, shear wall units, stair units, and other structural units which are connected, welded or bolted together to create volumetric blocks 705. Facade units, such as curtainwall units and core system components are also fitted at this time. For example, structurally formed blocks can be fitted with curtain wall (skin), and mechanical, electric and plumbing systems are connected or installed if not installed at the outfitting shop. Once completed, the blocks are transported to the jobsite for building erection using large cranes.

Figure 8:
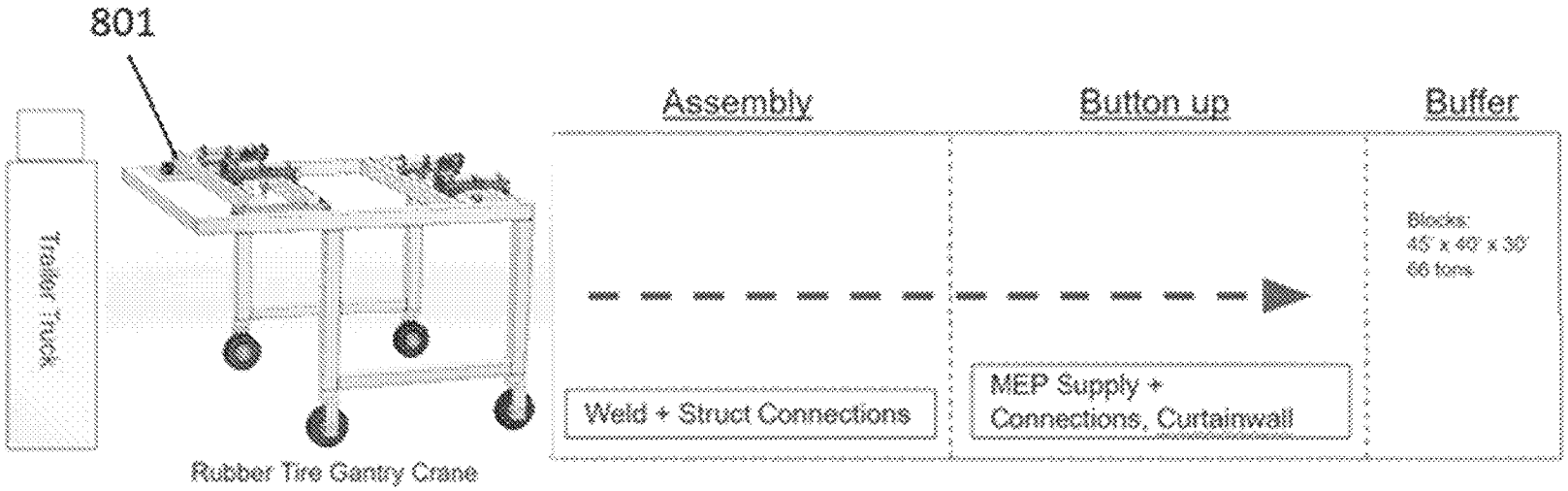
FIG. 8 is a schematic showing a workflow through an exemplary block yard assembly according to various embodiments.

FIG. 8 is a schematic showing a workflow through an exemplary block yard assembly according to various embodiments. As detailed in FIG. 8, the volumetric block assembly proceeds by welding (or otherwise connecting) the various linear and planar steel deck units, column units, shear wall units, stair units, and other structural units to form one or more volumetric blocks. Then, any MEP systems are connected and facade components are adjusted and affixed.

Figure 9:
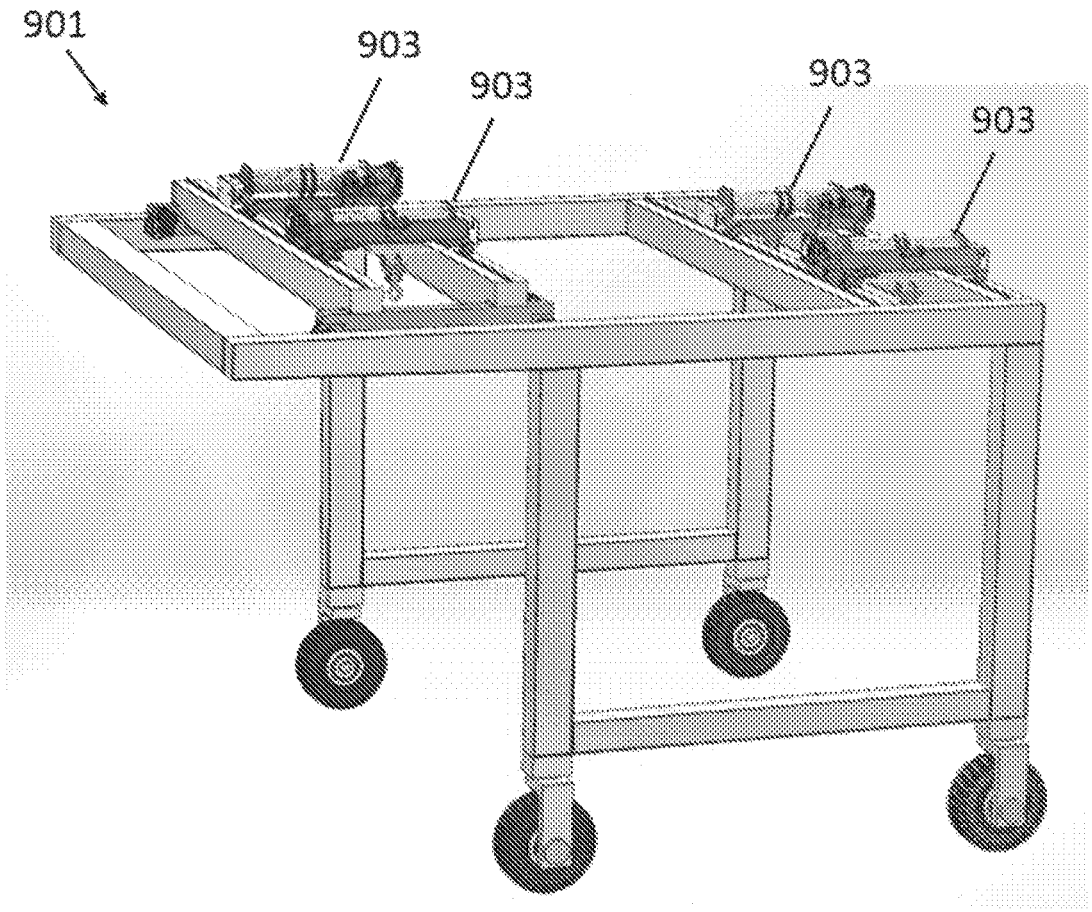
FIG. 9 depicts a detailed view of a gantry crane according to various embodiments.

FIG. 9 depicts a detailed view of a gantry crane according to various embodiments. In the example shown, a rubber tire gantry crane 901 having four hoists 903. In certain cases, the rubber tired gantry crane 903 is configured to do the following: offload steel units and other block assembly elements from a flatbed truck positioned perpendicular to the path of the crane, assemble blocks, and transport finished blocks down a street to a jobsite. In one example, two hoists are in a fixed longitudinal position but can translate laterally. And two hoists are on a gantry that can translate longitudinally and the hoists can translate laterally. This allows blocks of varying sizes to be picked up from four points at once without spreader bars or other excessive rigging that may require overhead clearance that is not available. Embodiments of the invention are not limited to the aforementioned and described gantry. Alternative gantries or hoisting apparatuses known to one of ordinary skill can be used in place. For example, any suitable crane (or lifting device) with the appropriate lifting capacity could be used.

Figure 10:
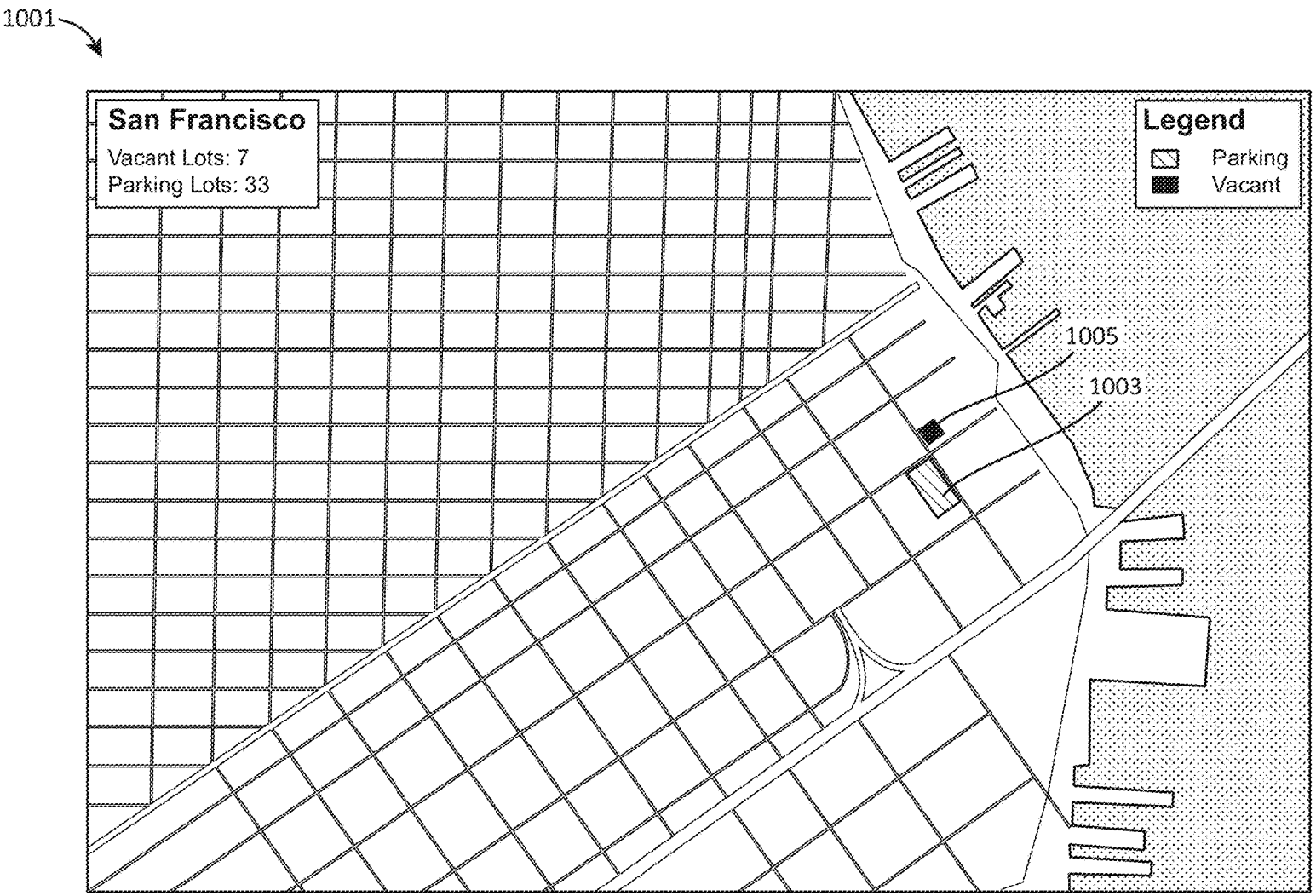
FIG. 10 is a map depicting suitable locations for a block assembly yard in a city according to various embodiments.

FIG. 10 is a map depicting suitable locations for a block assembly yard in a city according to various embodiments. In the example shown, a map 1001 of a densely populated city indicates that even in densely populated cities there are numerous suitable locations for a block assembly yard 1003 near a job site 1005. In an exemplary embodiment, a block assembly yard is 50 feet by 150 feet and is located in the central business district of a major city. If space allows, larger block assembly yards are possible and would provide greater production and efficiency. Block assembly yards include a means for receiving large prefabricated and pre-outfitted steel units. Large prefabricated facade units, core systems components, and other materials. Offices and worker facilities are provided. Means are provided to assemble the blocks from their structural elements. Means are provided for precise alignment of elements. Welding equipment, paint equipment, and means to efficiently complete all block assembly tasks with mass production efficiency are provided.

In some embodiments, block assembly yards may be located near jobsites, when the block weight, size and dimensions are large enough to make transporting long distances impractical. Based on detailed research and analysis of modern city layouts and planning, most central business districts have suitable candidate sites for block assembly yards. For example, as seen in FIG. 10, the city of San Francisco, Calif. has at least 7 vacant lots and 33 vacant parking lots optimally positioned in the downtown area that are suitable for a block assembly yard. Similar analyses have been conducted for other major U.S. cities.

5) Non-Structural Module Factory

In parallel with the block manufacturing, assembly, and erection process, non-structural accommodation modules are fabricated at an accommodation module plant. At the accommodation module plant, bedroom, bathroom, living room, kitchen and other accommodation elements are assembled on a station assembly line. In an exemplary embodiment, the station assembly line is a forty station line that can assemble at the rate of up to twelve 560 square foot accommodation modules per day. The accommodation modules are sound-rated and fire-rated while avoiding gypsum board assemblies. The accommodation modules are substantially (nearly 100%) pre-finished including wall coverings, cabinets, countertops, fixtures, appliances etc. They are shipped by conventional flatbed ready to plug and play in the block tower. Accommodation module installation takes approximately 30-60 minutes. Once the volumetric modules are assembled into the building frame and all non-structural modules are installed, the only activities remaining for building completion are common area finishes and building commissioning.

Returning to FIG. 6, a non-structural module factory 613 may include a module accommodation factory. The non-structural module factory 613 may include a centralized factory where non-structural prefabricated accommodation modules are fabricated. At this plant, bedroom, bathroom, living room, kitchen, office, lobby, entertainment elements, hotel room, hospital room, and other accommodation modules are assembled on a station assembly line. In an exemplary embodiment, the station assembly line is a forty station line that can assemble at the rate of up to twelve 560 square foot accommodation modules per day. The accommodation modules may be sound-rated and fire-rated while avoiding gypsum board assemblies. The accommodation modules are substantially (nearly 100%) pre-finished including wall coverings, cabinets, countertops, fixtures, appliances etc. They are shipped by conventional flatbed trucks to job site 609. The accommodation modules may be ready to plug and play in the block tower by attaching to, connecting to or interfacing with structural blocks. An accommodation module is only for residential building, or the residential portion of a building. In other embodiments, the non-structural module factory is configured to assemble and outfit non-structural modules for other purposes (e.g. office buildings).

Figure 11C:
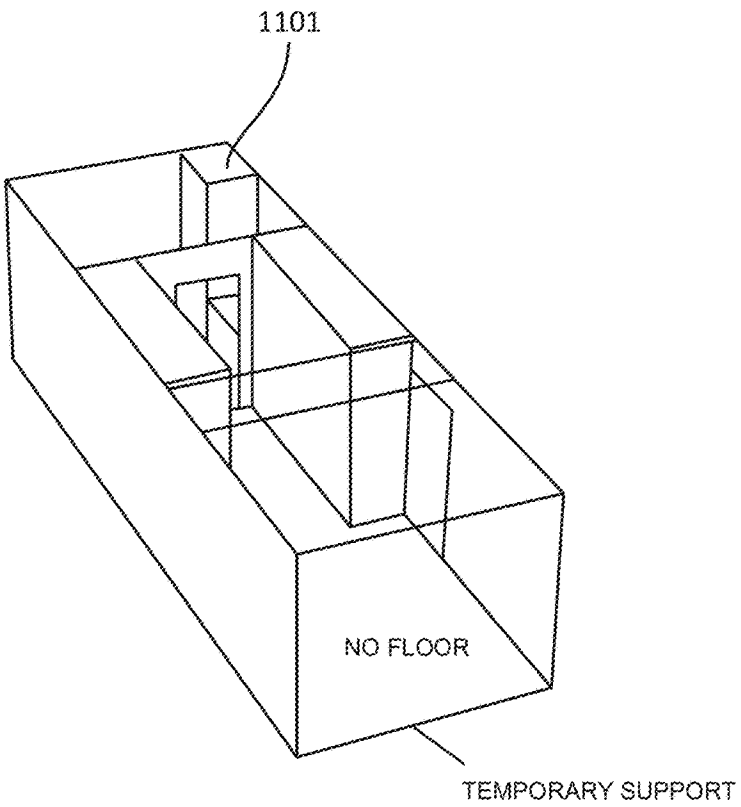
FIG. 11C depicts a third view of the bedroom accommodation module of FIG. 11A according to various embodiments.
Figure 11A:
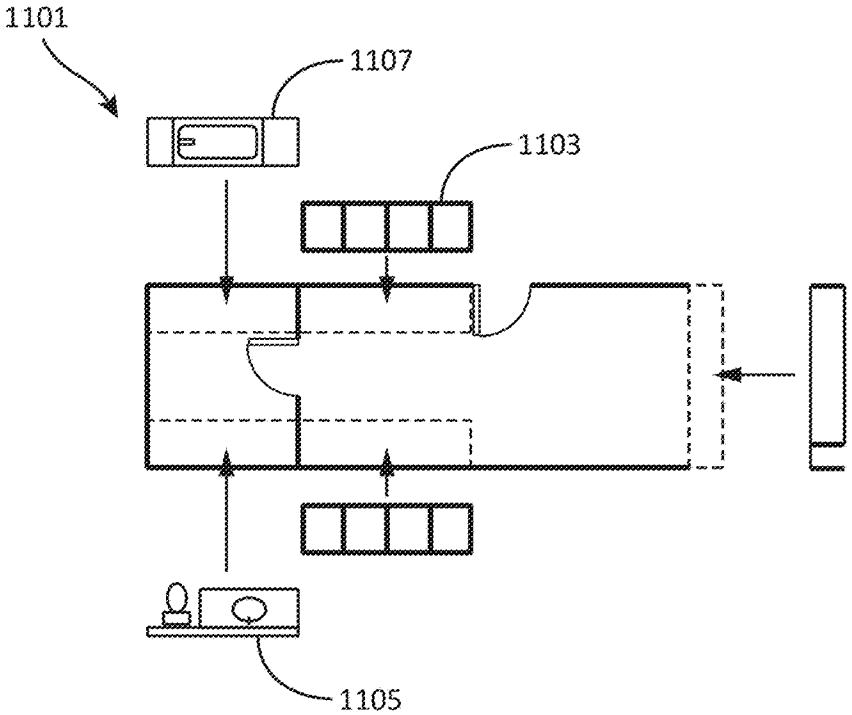
FIG. 11A depicts a first view of a bedroom accommodation module according to various embodiments.
Figure 11B:
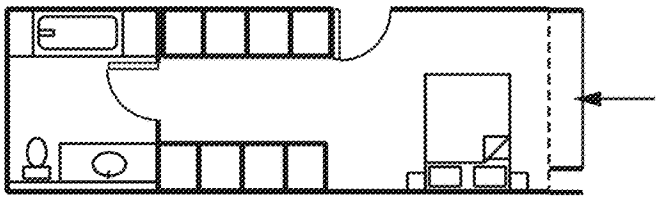
FIG. 11B depicts a second view of the bedroom accommodation module of FIG. 11A according to various embodiments.

FIGS. 11A-C depict a bedroom accommodation module in multiple views according to various embodiments. In the example shown, a bedroom accommodation module 1101 (e.g., non-structural module) includes various prefabricated elements, such as closet fixtures 1103, bathroom fixtures 1105, bathtub fixtures 1107, walls, doors, and/or other components. The bedroom accommodation module 1101 includes the basic features of a bedroom. In certain cases the bedroom accommodation module 1101 does not include a floor. The bedroom accommodation module 1101 may be configured to be affixed to a structural block, such as a deck block. And the deck block will include a floor, so including a floor in the bedroom accommodation module 1101 may not be necessary.

Figure 12C:
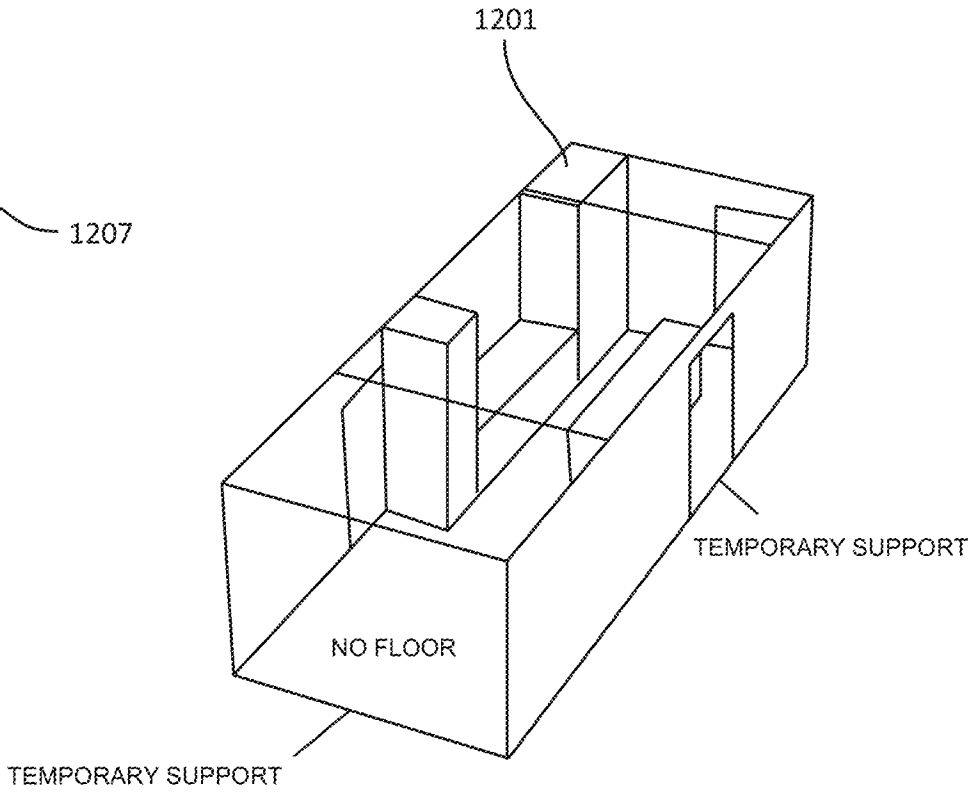
FIG. 12C depicts a third view of the living room accommodation module of FIG. 12A according to various embodiments.
Figure 12A:
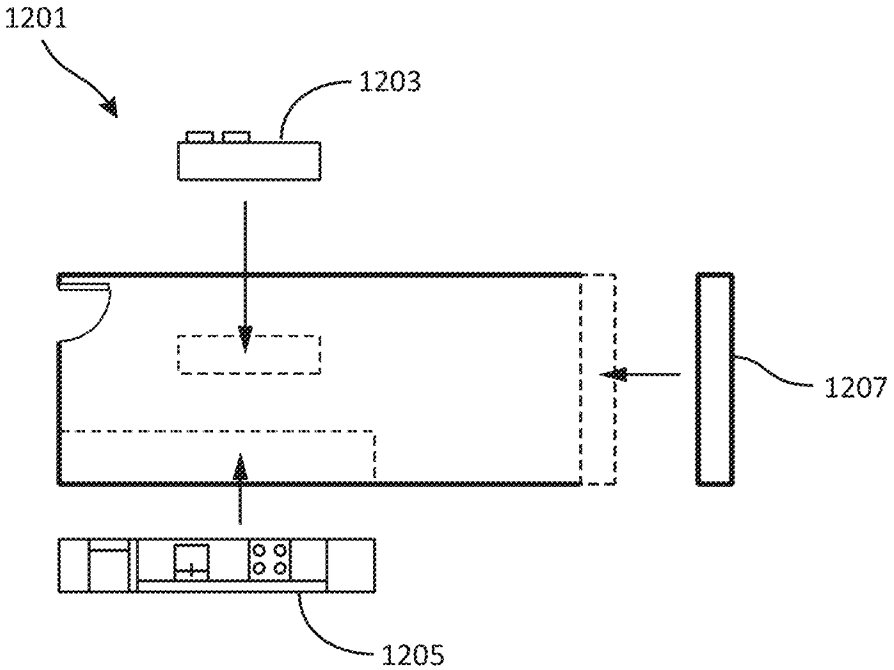
FIG. 12A depicts a first view of a living room accommodation module according to various embodiments.
Figure 12B:
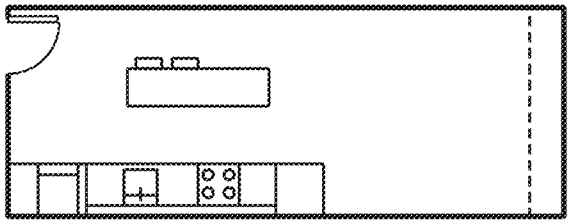
FIG. 12B depicts a second view of the living room accommodation module of FIG. 12A according to various embodiments.

FIGS. 12A-C depict a living room accommodation module in multiple views according to various embodiments. In the example shown, a bedroom accommodation module 1201 includes various prefabricated elements, such as counter tops 1203, kitchen fixtures and/or appliances 1205, doorways 1027, and/or other components. The living room accommodation module 1201 may be configured to be affixed to a structural block, such as a deck block.

Figure 13B:
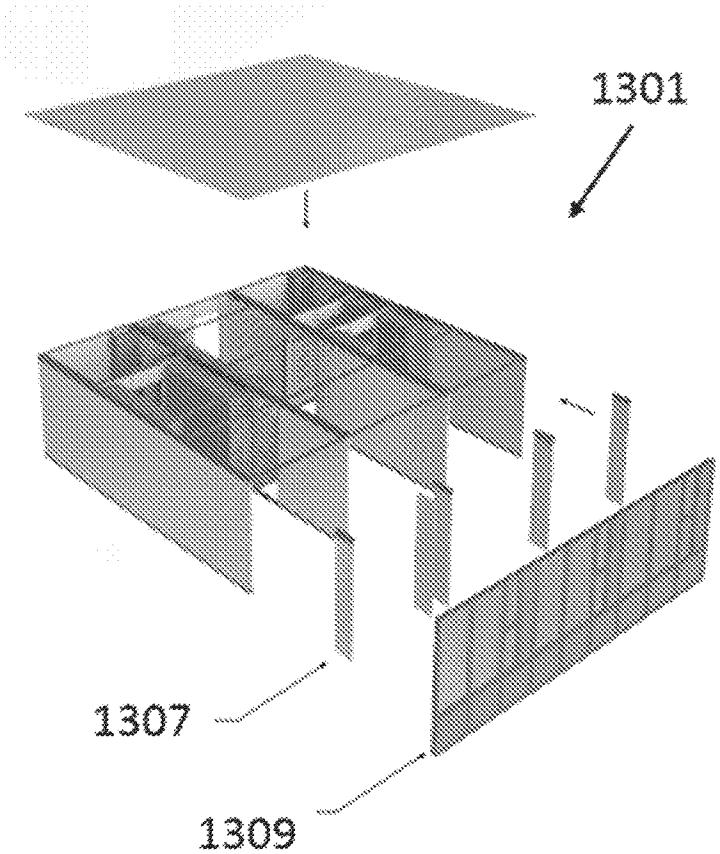
FIG. 13B depicts a second view of the two bedroom unit accommodation module of FIG. 13A according to various embodiments.
Figure 13A:
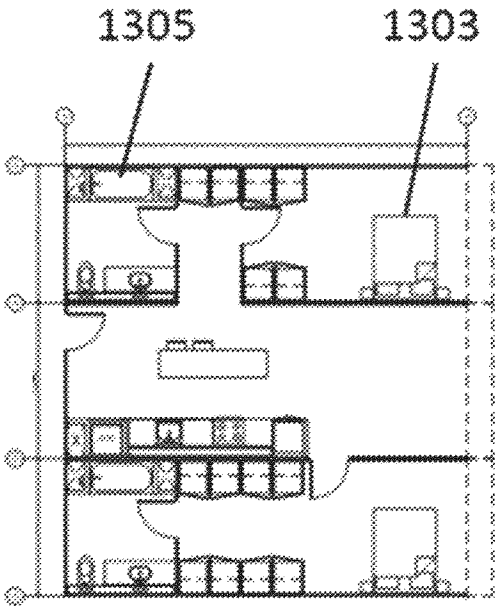
FIG. 13A depicts a first view of a two bedroom unit accommodation module according to various embodiments.

FIGS. 13A-B depict a two bedroom unit accommodation module in multiple views according to various embodiments. In the example shown, a two bedroom unit accommodation module 1301 includes fixtures, furniture and appliances for a two bedroom apartment. For example, the two bedroom unit accommodation module 1301 may include beds 1303, bathroom fixtures and plumbing 1305, walls, doorways, filler caps 1307, and/or other components. Upon installation into block, such as a deck block, the two bedroom unit accommodation module 1301 may be attached to curtainwall systems 1309 included in the block unit.

6) Jobsite or Building Erection Site

In various embodiments, structural blocks 607 are transferred from the block assembly yard 605 to the job site 609 and assembled into a building frame. The structural blocks 607 are assembled into the building frame, the non-structural modules 615 are inserted into the building frame, and the non-structural modules 615 are integrated into the structural blocks 607.

Figure 14:
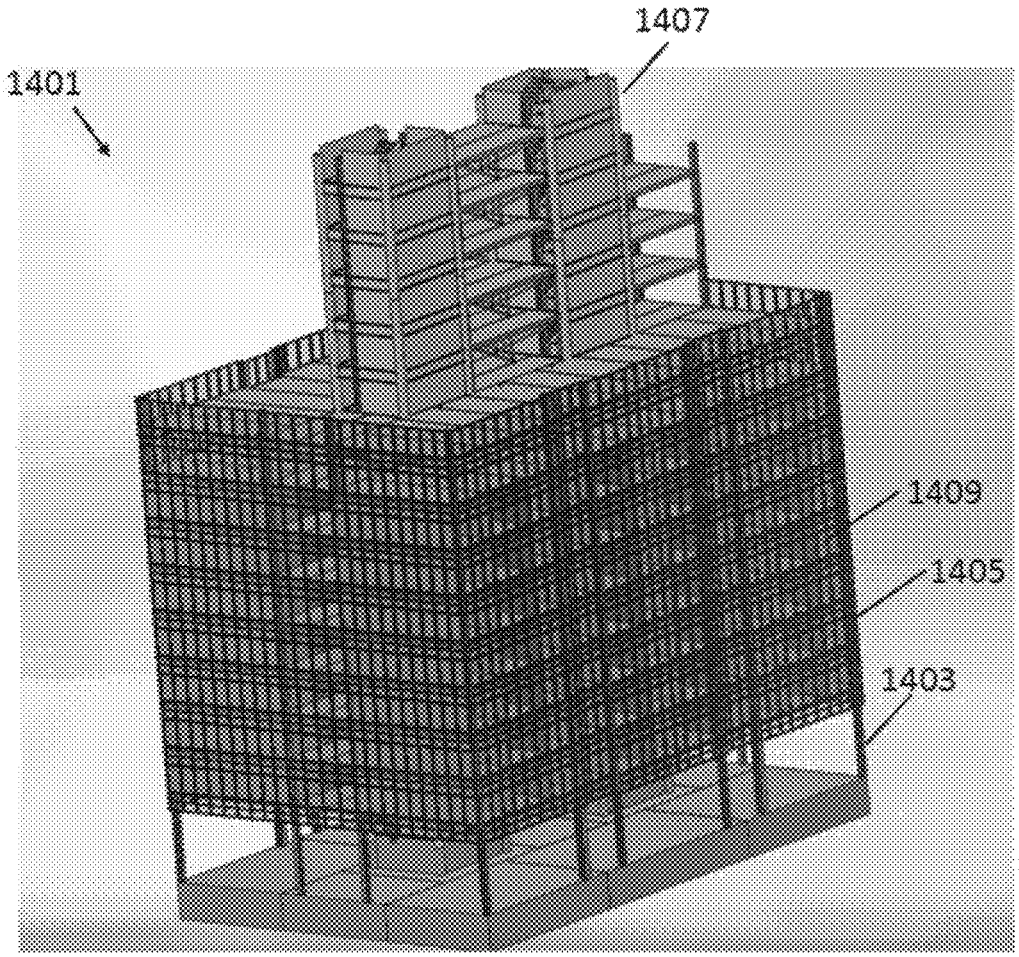
FIG. 14 is an exemplary embodiment of a building constructed using modular block construction techniques according to various embodiments.
Figure 15:
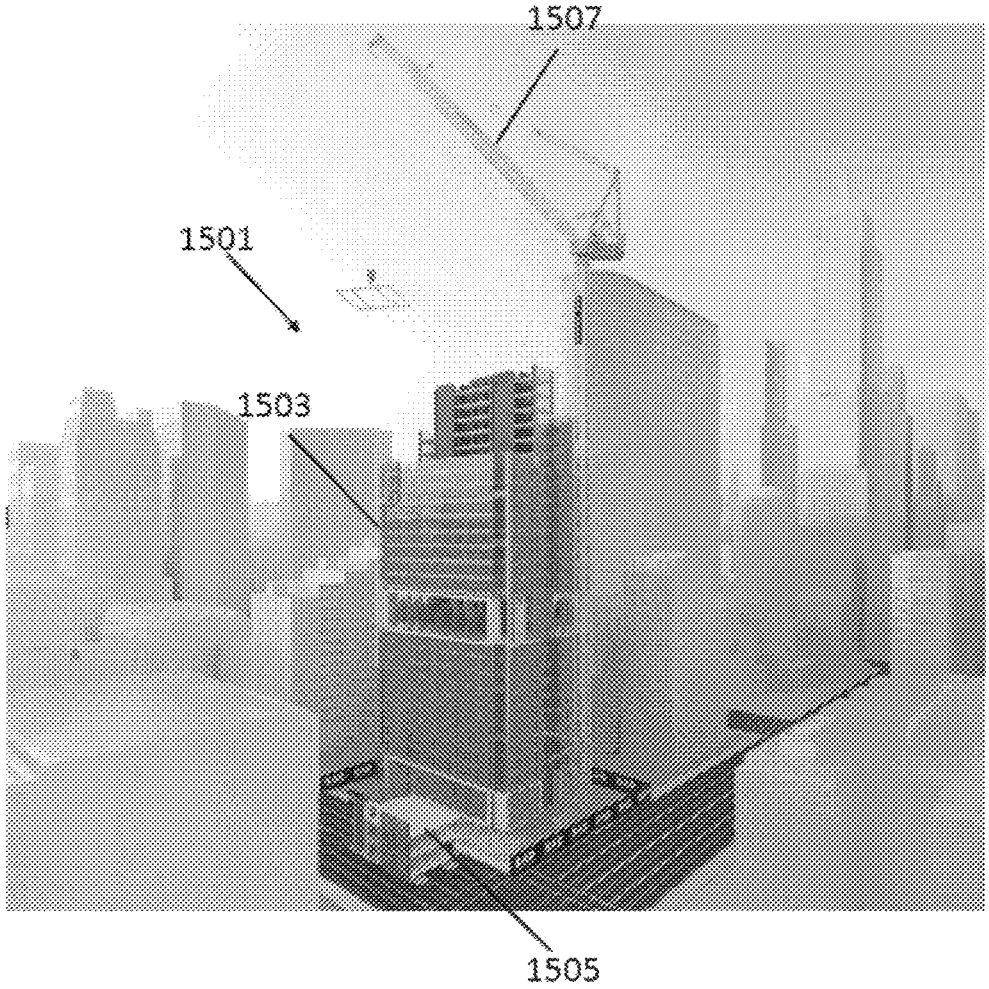
FIGS. 15-26 include depicts a process of assembling a building from volumetric blocks according to various embodiments.

FIG. 14 is an exemplary embodiment of a building constructed using modular block construction techniques according to various embodiments. The modular building 1401 includes assembled volumetric blocks 1403, 1405, 1407. The building 1401 may include foundation blocks 1403, deck blocks 1405, core blocks 1407, accommodation modules 1409, and/or other components.

FIGS. 15-26 include depicts a process of assembling a building from volumetric blocks according to various embodiments. In the example shown in FIG. 15, at a job site 1501 a building frame (building) 1503 is assembled. A crane 1507 may transfer blocks 1505 from a block assembly yard (not shown), a transport vehicle, and/or other location on the building frame 1503. In certain cases, multiple blocks 1505 stacked to form the structural elements of the building frame 1503. The crane 1507 may include, for example, a job tower crane and/or any other suitable device.

Figure 16:
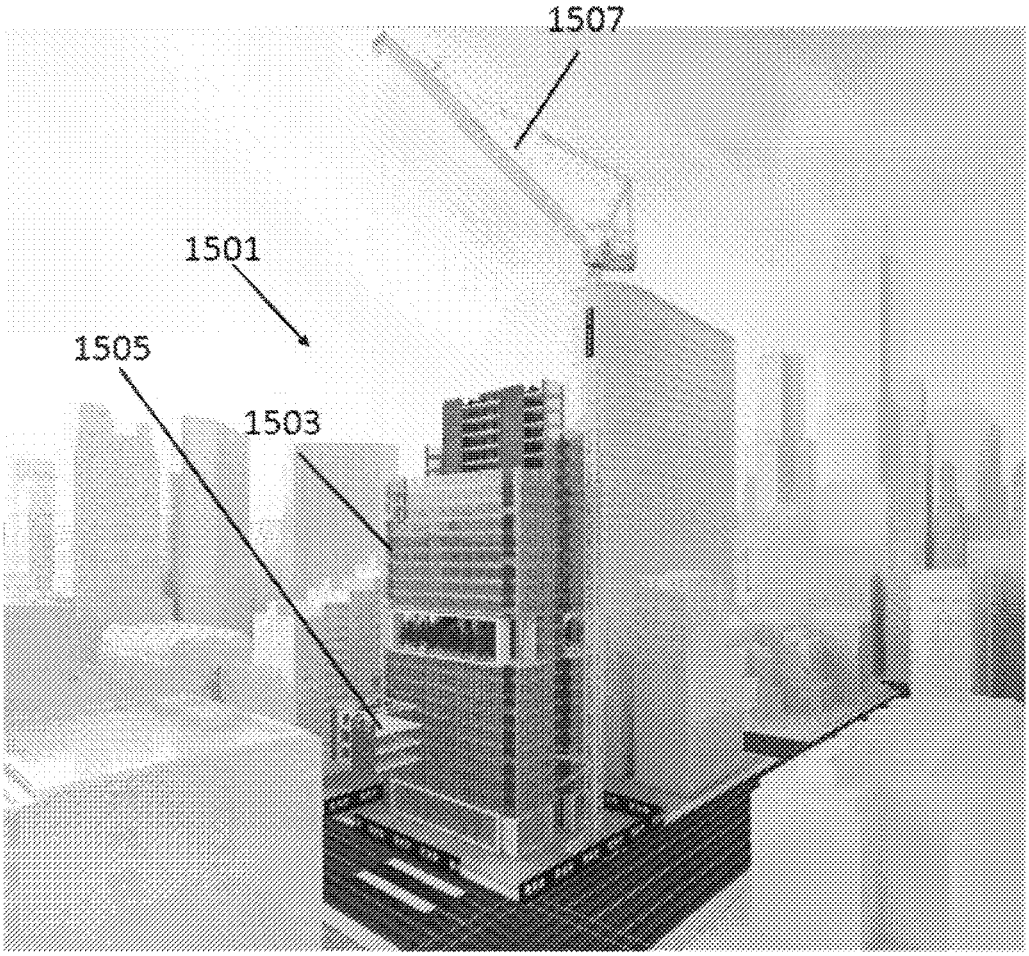
Figure 17:
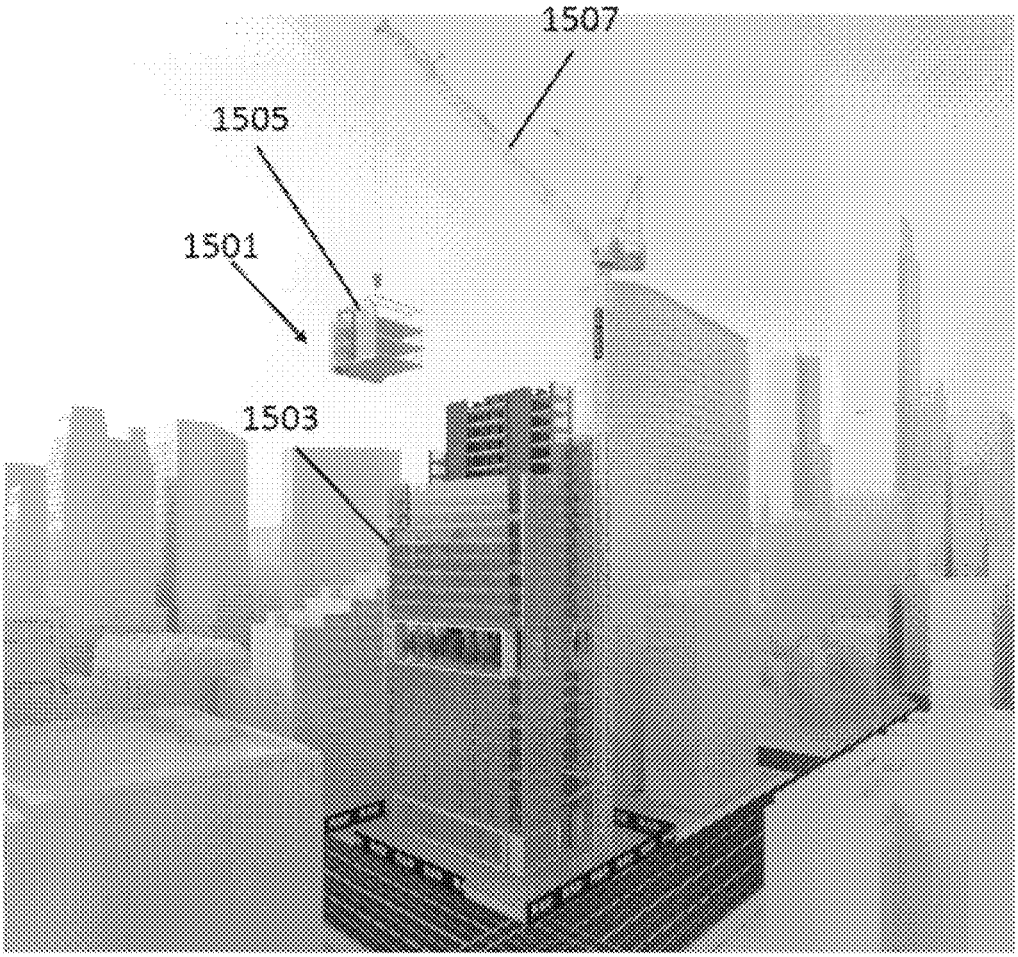
Figure 18:
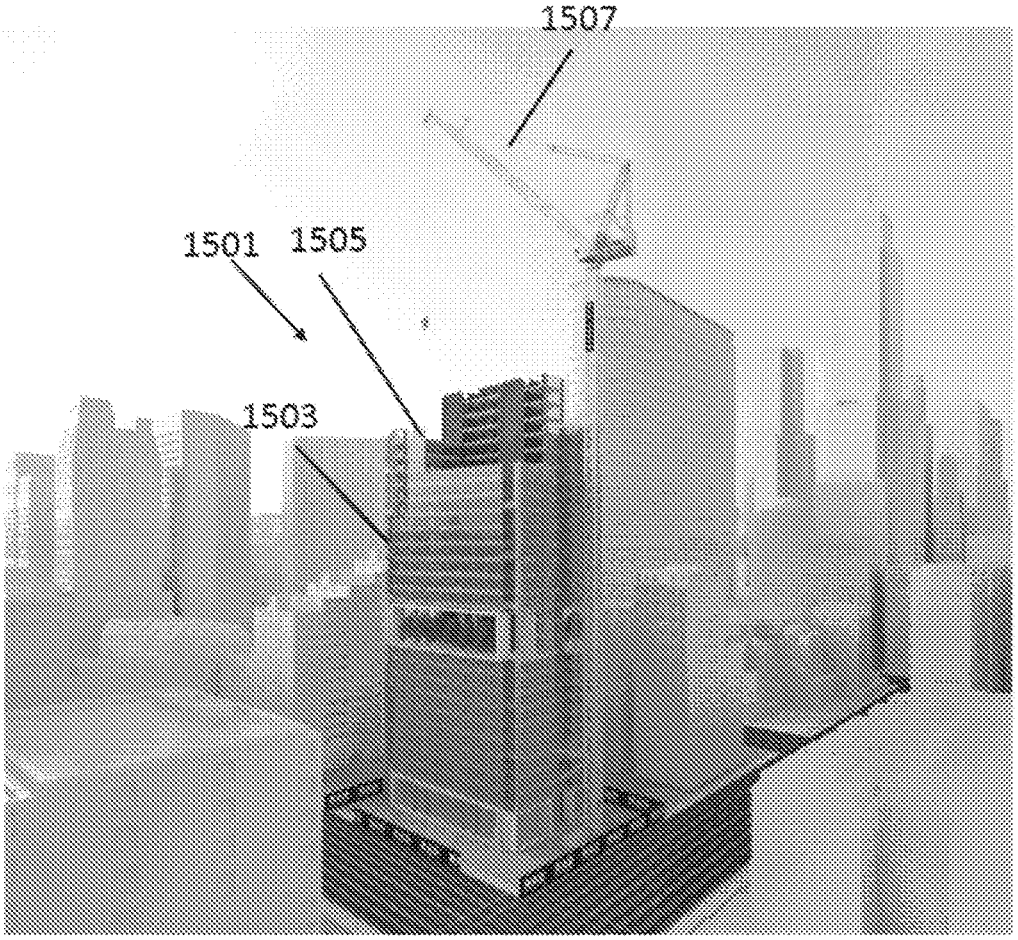

In the example shown in FIGS. 16-18, a deck block 1505 is lifted off the ground and placed in an appropriate location on the building frame 1503. In the example shown, a deck block 1505 is placed on top of another deck block previously installed in the building frame 1503.

Figure 19:
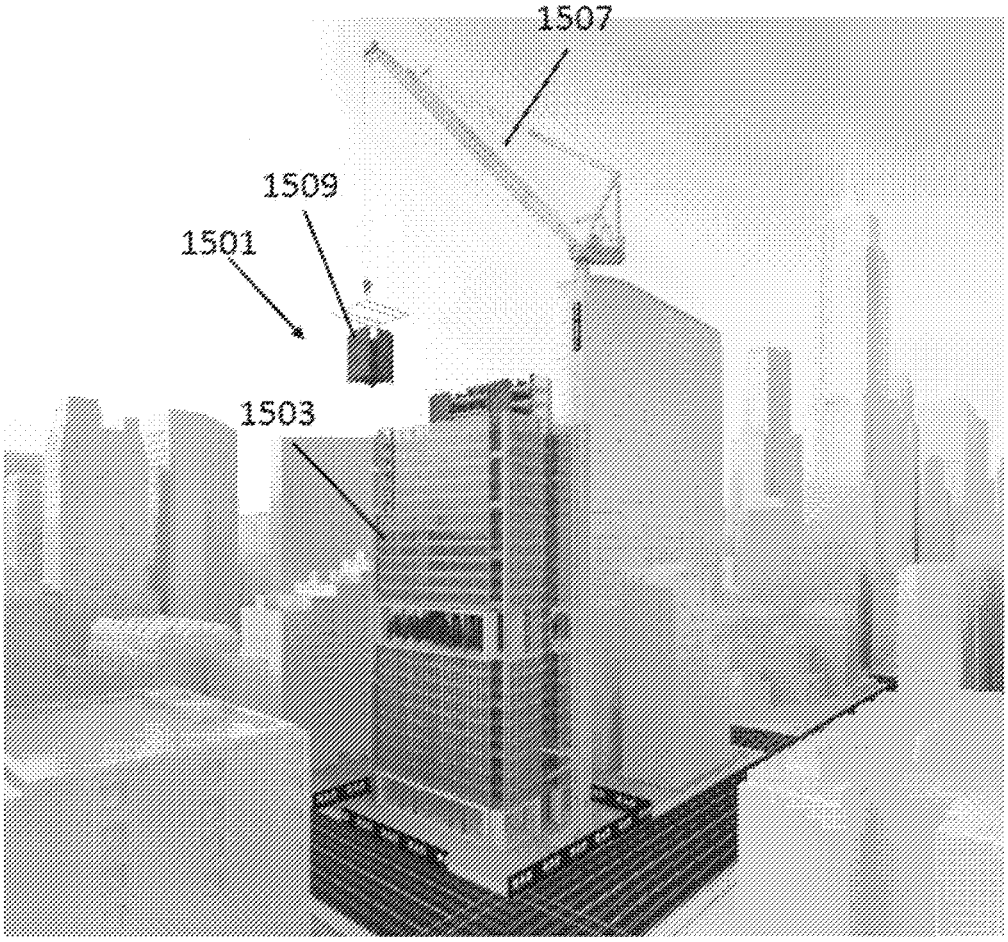
Figure 20:
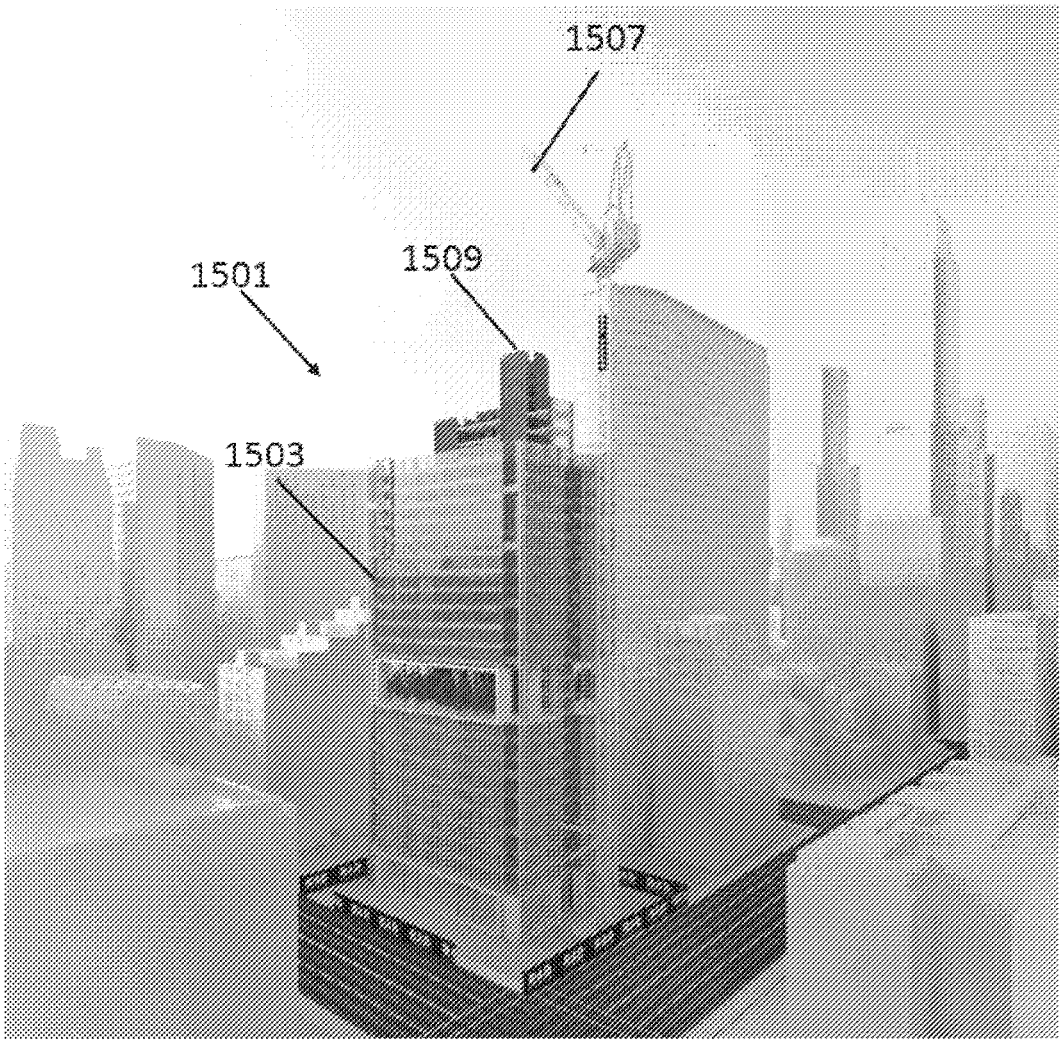

In the example shown in FIGS. 19-20, a core block 1509 is lifted from the ground by a crane 1507 and placed onto the building frame 1503. In the example shown, a core block 1509 is placed on top of another core block previously installed in the building frame 1503.

Figure 21:
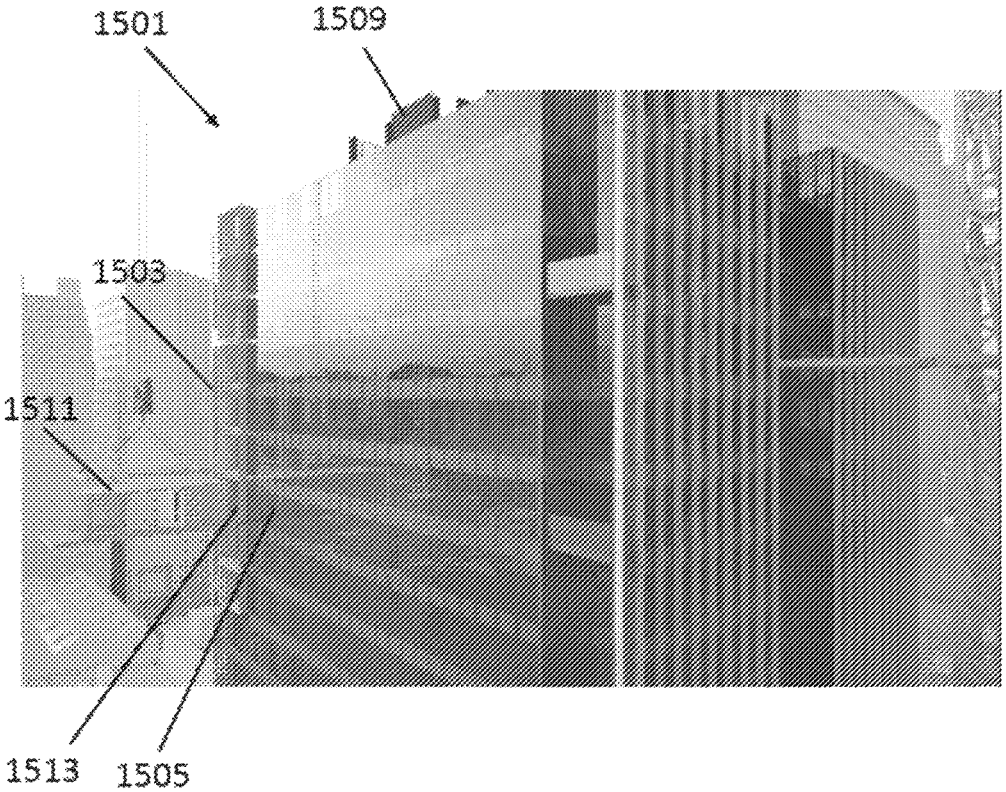
Figure 22:
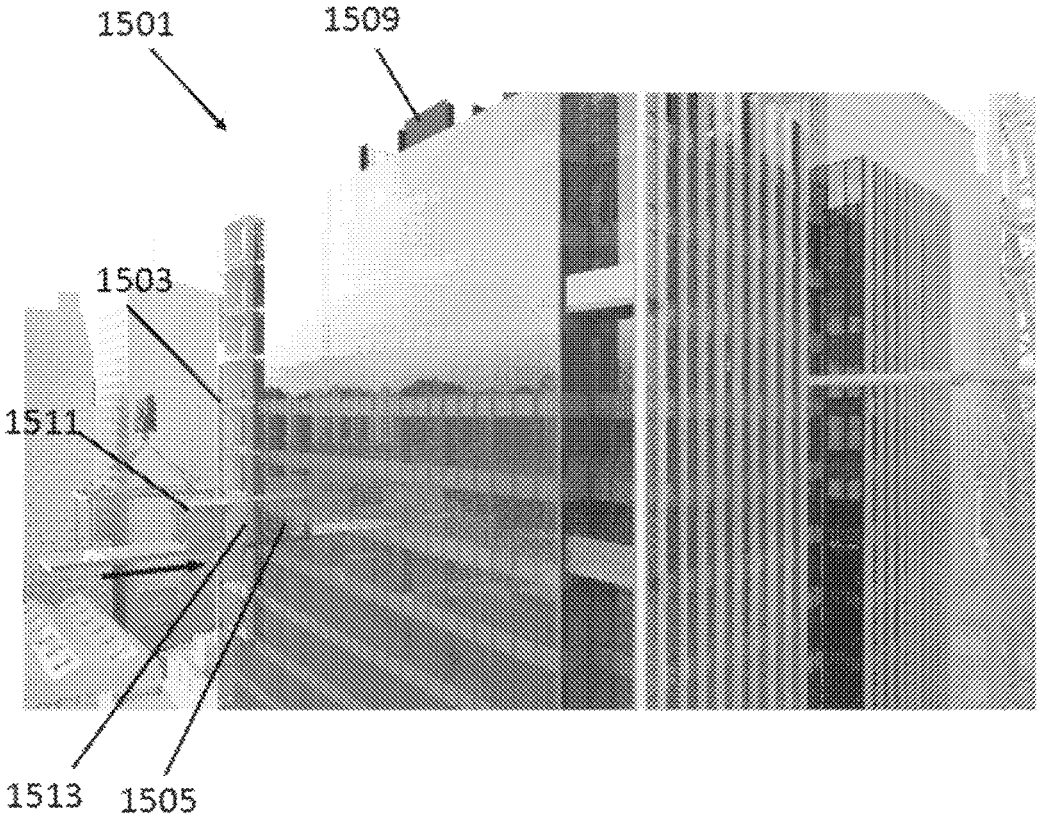
Figure 23:
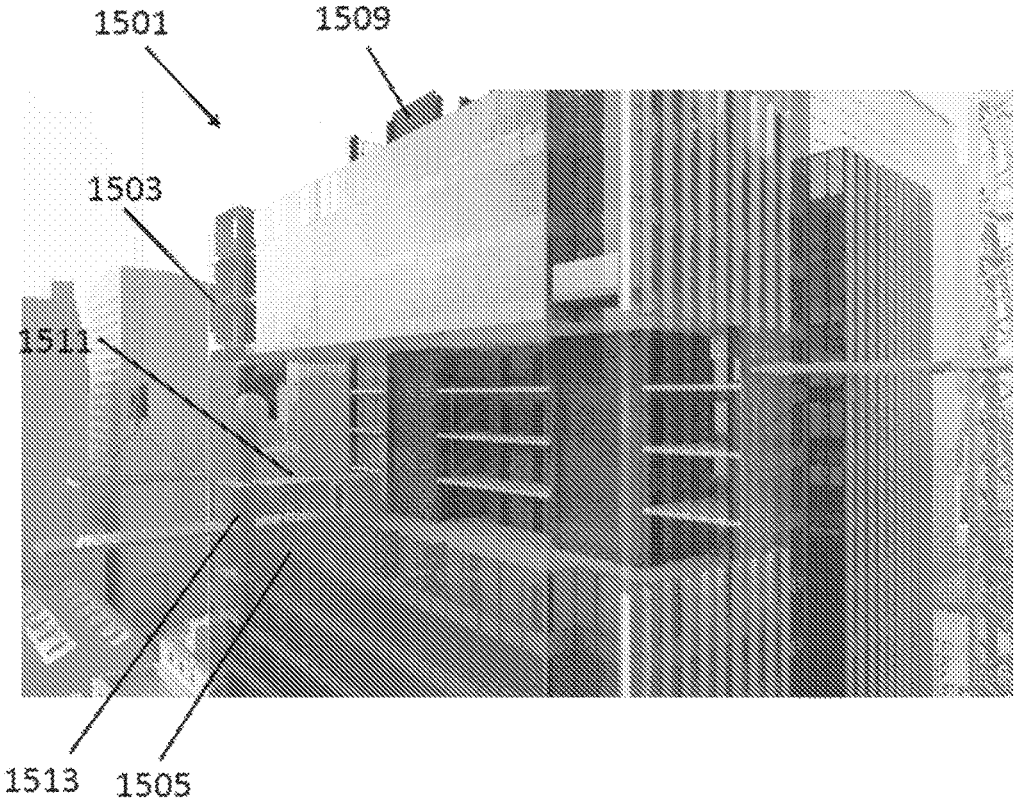

In the example shown in FIGS. 21-25, accommodation modules 1511 are installed into a building frame 1503 at the job site 1501. In certain cases, accommodation modules 1511 are installed in the building frame 1503 after all or a substantial portion of the structural blocks 1505, 1509 have been assembled in the building frame 1503. As shown in FIG. 21, an accommodation module 1511 may be inserted into an accommodation module receiving structure 1513 (e.g., an opening) in the building frame. For example, the building frame 1503 may include accommodation module receiving structure 1513 specifically configured to receive an accommodation module 1511. The accommodation module receiving structure 1513 may, for example, be component of or installed in one or more deck blocks 1505. In certain cases, the accommodation module receiving structure 1513 may be temporary until one or more accommodation modules 1511 have been inserted in the building frame 1503 and then subsequently removed.

Figure 24:
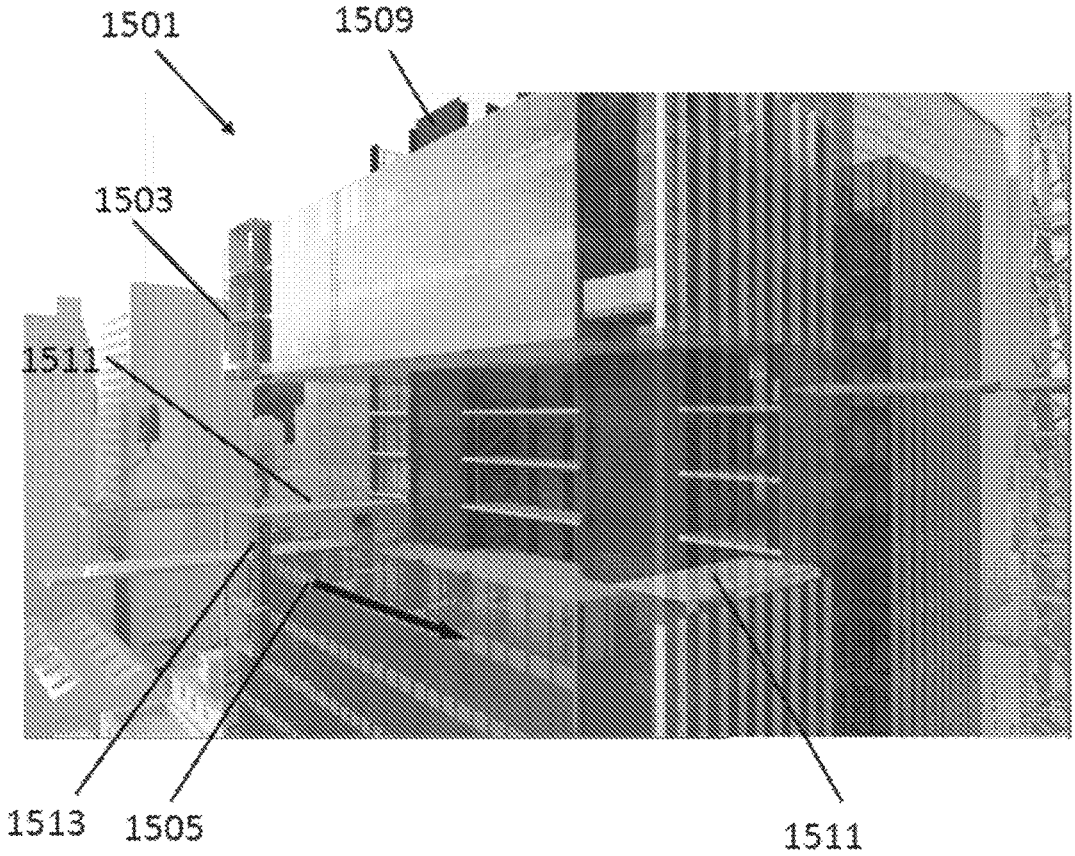
Figure 25:
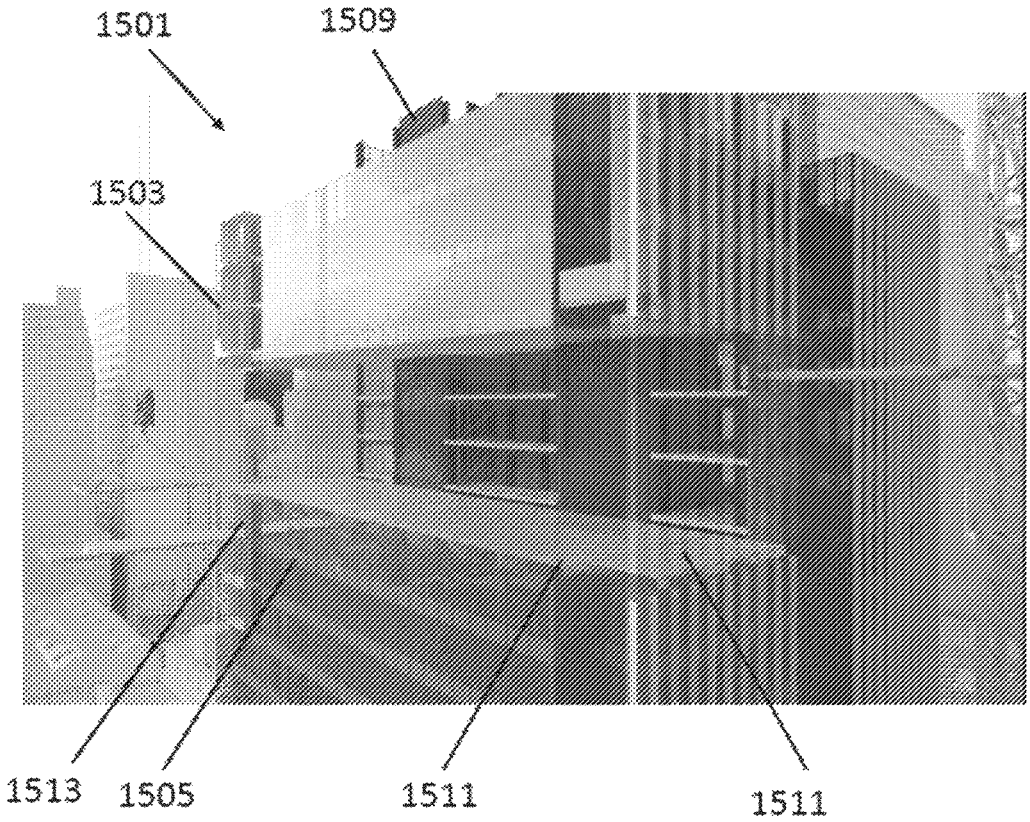
Figure 26:
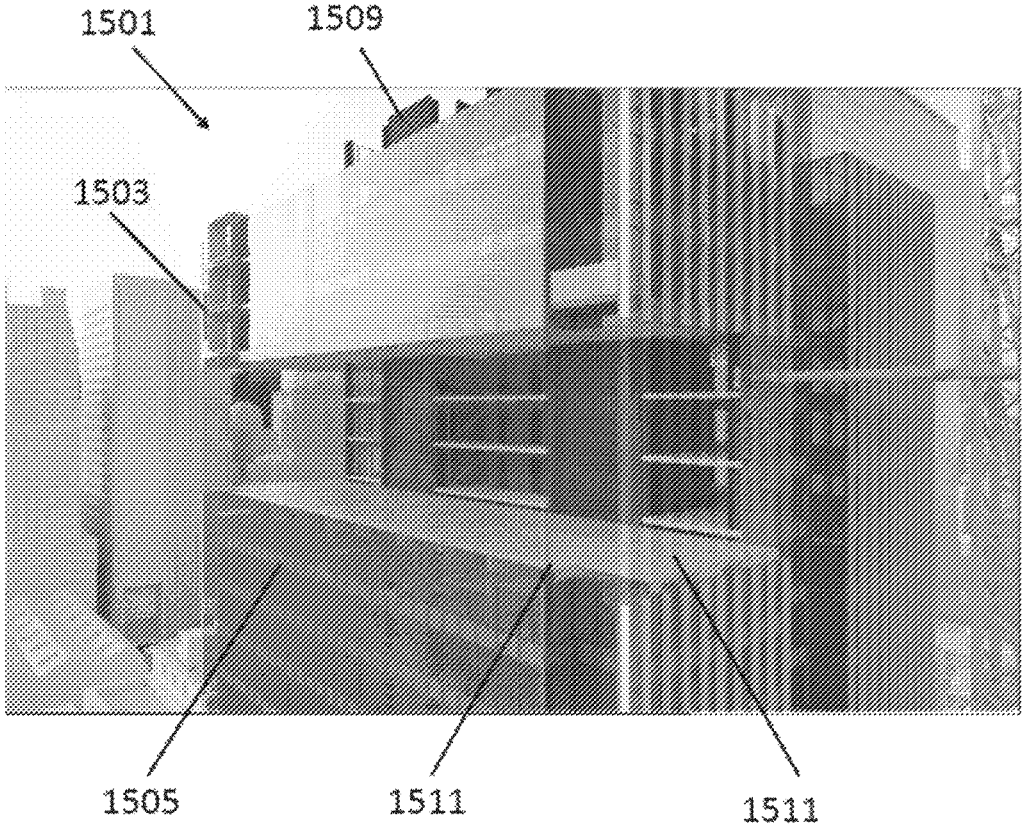

In the example shown in FIGS. 22-26, the accommodation module 1511 is inserted fully into the building frame 1503. Once inserted into the building frame 1503, the accommodation module 1511 is moved to an appropriate location. As shown in FIG. 24, the accommodation module 1511 is moved to the opposite end of the building frame 1503 from the accommodation module receiving structure 1513. This process may be repeated to install multiple accommodation modules 1511 within the building frame 1503. The selection of the accommodation modules 1511 (e.g., bedroom unit module, living room module, office module, etc.) may dictate the layout of the building on completion. In this way various accommodation module 1511 can installed in any order to define custom or unique layouts for each floor within the building frame 1503. FIG. 25 depicts multiple accommodation modules 1511 installed on a particular floor of the building frame 1503. In certain cases, when the accommodation module 1511 is positioned in the proper location, the accommodation module 1511 may be affixed to a portion of a structural block 1505. In some instances, the structural block 1505 may be configured to receive an accommodation modules 1511. For example, the accommodation module 1511 may snap into place in a structural block 1505, may be configured to fasten to the structural block 1505, and/or otherwise attach. As shown in FIG. 26, after multiple accommodation modules 1511 have been installed in a particular part (e.g., floor) of the building frame 1503 the accommodation module receiving structure 1513 (not shown) may be removed.

Figure 27:
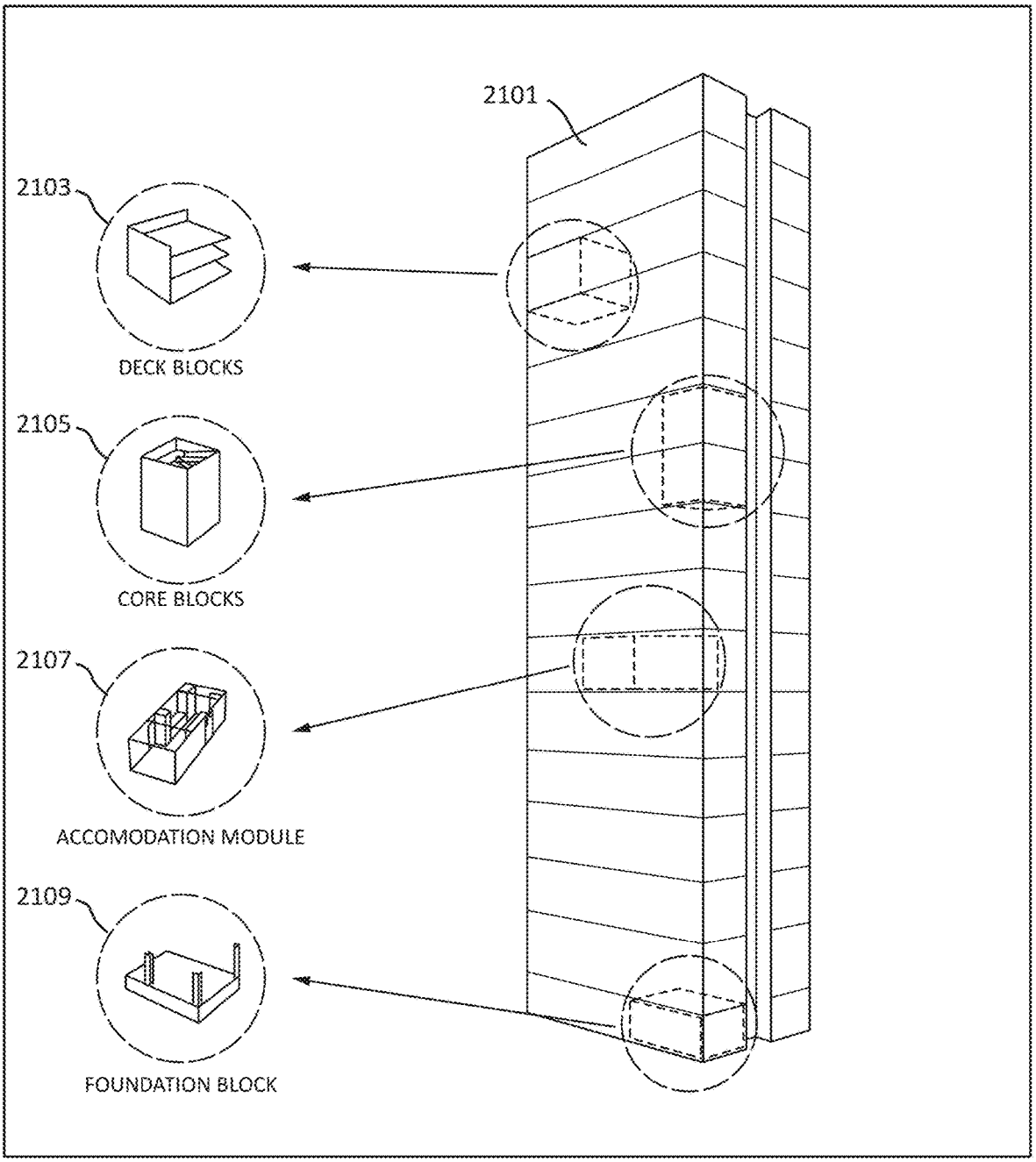
FIG. 27 is a schematic depicting a building constructed using the block construction techniques disclosed herein.

FIG. 27 is a schematic depicting a building constructed using the block construction techniques disclosed herein. In the example shown, a building 2101 includes deck blocks 2103, core blocks 2105, foundation blocks 2109, accommodation modules 2107 (e.g., non-structural modules) installed in the blocks. The non-structural modules 2107 are installed into a building frame 2101 defined the blocks 2103, 2105, 2109. The non-structural modules 2107 may, for example, be affixed to one or more of the blocks 2103, 2105, 2109 during assembly at the job site. The non-structural modules 2107 may, for example, be configured to be set within one or more blocks 2103, 2105, 2109 in the building frame 2101.

Example Benefits of the Block Construction Techniques

In an exemplary embodiment of a block construction method, a tall building can be broken down into large structural blocks with weights of up to 66 tons and dimensions of up to 45 feet in width, 40 feet in length, and 30 feet in height. The blocks have their exterior facades in place, as well as fire-proofing, insulation, core building systems, and weather tight decks. The blocks are assembled in a block assembly yard which is an enclosed production environment near the job site and transported to the jobsite for building erection using, for example, large cranes. In an exemplary embodiment of a modular building, a 30-story residential tower with 300 units may consist of 110 blocks with an assembly rate of 1 block per day. This means that the tower is topped out with structure complete, weathertight skin, and core systems in-place in under six months.

The exemplary embodiments of modular block construction disclosed herein offer several advantages to modern construction.

For example, in one or more of the exemplary embodiments disclosed herein, the final construction can be broken down into volumetric blocks. The final construction includes volumetric blocks, which contain the structural systems, the MEP systems, the curtain wall, the fire system and all other essential components of making a building function.

One or more of the exemplary embodiments disclosed herein include a welded steel deck. In such embodiments, the floor sections consist of a "stiffened steel" plate. To achieve this, a deck plate was supported by several "longitudinal" flat bar stiffeners and five "transverse" gliders. In such embodiments, the term "longitudinal" is considered to be the long axis of the volumetric module and the "transverse" is the short axis. The transverse girders are slotted to allow the stiffeners to pass through. An advantage of such embodiments is that this reduces the overall part count, which in turn reduces modeling complexity and the contractor material handling effort. In one or more of the exemplary embodiments disclosed herein, the stiffeners are welded to the deck upside-down utilizing a panel welder, which welds all the stiffeners to the deck at once. The girders, which are notched to accommodate the stiffeners, are then landed to the upside-down panel. In one or more of the exemplary embodiments disclosed herein, the stiffeners are the tertiary structure (small stiffeners supporting the plating from local deformation) to support the local deck plating to reduce the potential springing sensation of the panel. Flat bar sections are also included as they are easy to work with, shape, and they provide adequate support of the deck plating. The girders provide support for the deck plating and deck stiffeners and also provide intermittent attachment points for a "Closure Panel" located at the bottom of the module. They are notched so as to allow the stiffeners to pass through but still provide lateral support (tripping). The girders can be made either of a flanged plate or built-up member. The bottom surface of the girder is used to weld to the closure plate. The bottom "closure panel" creates a smooth surface for fireproofing installation. The panel also serves a critical function as the bottom flange of the primary structure box beam. This will give the panel significant strength in bending. In one or more of the exemplary embodiments disclosed herein, when welded together, the steel decks provide an effective rain barrier that protects accommodation modules and finishes being installed at lower level.

In one or more of the exemplary embodiments disclosed herein, a prefabrication factory is employed to manufacture the non-structural modules. The building of non-structural modules (e.g. accommodation modules with no structural components) within a factory that is centrally located is unique. In some embodiments of the invention, such non-structural modules are 100% prefabricated with 5 sides (missing a floor). Such modules are welded in place on the building frame. In one or more of the exemplary embodiments disclosed herein, the walls of the non-structural modules are made from sandwich panels. The sandwich panels can be skinned with steel, aluminum or fiberglass. The core material can be mineral wool, honeycomb (aluminum or plastic), or foam.

In one or more of the exemplary embodiments disclosed herein, the non-structural modules fit tightly in the decks of the building and are loaded through a temporary opening left in the facade for this purpose. In such embodiments, the path of the accommodation module from the opening to its final position must be carefully planned. The path that is taken by the setting crew/installation crew is critical to the success of the successful construction of the building. This is a non-obvious piece of the process. Also, it provides a clear advantage over traditional building methods in that it reduces the time and labor required to build in or integrate a living or working space into a building.

In one or more of the exemplary embodiments disclosed herein, a block yard is used to assemble the structural units into a plurality of volumetric blocks. In such embodiments, buying land/real estate which works like a closed space near the work site (or building erection site) is a novel solution which allows increased portions of the building to be built in a factory-like setting. This allows for an increase in the portion of the building constructed in a high productivity manufacturing setting from 50% to 95%. In addition, such a process of volumetric block assembly in a block yard along with the specific equipment used in the block yard has not previously been conceived. In one or more of the exemplary embodiments disclosed herein, use of the rubber tire gantry crane shown in FIG. 6 in the block yard has not previously been conceived. Also, the size of the block yard at 50 feet by 50 feet and the ability to set-up such locations in a central business district of a city have not previously been conceived.

In one or more of the exemplary embodiments disclosed herein, steel fabrication and outfitting is done at designated location (or shop). In such embodiments, the use of such a location or shop for putting put in place all the service lines and needs was not previously been conceived. In one or more of the exemplary embodiments disclosed herein, the use of steel fabrication that can be handled by ground transport has also not been previously been conceived.

In one or more of the exemplary embodiments disclosed herein, transportation of the volumetric blocks is done via the use of a rubber tire gantry crane after business hours so as to cause minimal disruptions near the building site during normal business hours. Such a feature is a novel and non-obvious solution over existing building methods. Modular construction wherein the building is broken up into structural components along with non-structural accommodation modules is a novel concept. Furthermore, doubling up the gantry crane for loading blocks and transporting blocks increases efficiency, and the ability of the crane to be potentially self-leveling and move in all axis provides enhanced capabilities.

The embodiments illustrated and discussed in this specification are intended only to teach those skilled in the art the best way known to the inventors to make and use the invention. Nothing in this specification should be considered as limiting the scope of the present invention. All examples presented are representative and non-limiting. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

What is claimed is:

1. A method for building a modular building comprising:

assembling, at an assembly site, a plurality of pre-fabricated structural units into a plurality of volumetric blocks, wherein at least one of the plurality of volumetric blocks comprises one or more of the plurality of pre-fabricated structural units and at least one mechanical, electrical, or plumbing system, wherein the plurality of pre-fabricated structural units are fabricated at a location separate from the assembly site prior to assembly into the plurality of volumetric blocks, wherein the at least one of the plurality of volumetric blocks comprises a deck block and wherein assembling the plurality of pre-fabricated structural units into the plurality of volumetric blocks comprises assembling the deck block to have a plurality of deck units, one or more columns, and a facade component, and incorporating the at least one mechanical, electrical, or plumbing system into at least one of the plurality of deck units, wherein assembling the deck block further comprises affixing an edge of each of the plurality of deck units to a column of the one or more columns at a location on the column distant from ends of the column;

assembling, at a building site separate from the assembly site, the plurality of volumetric blocks into a building frame;

inserting, at the building site, at least one non-structural module into the building frame by inserting the at least one non-structural module between two of the plurality of deck units of the deck block, each of the at least one non-structural modules comprising one or more walls; and affixing, at the building site, the at least one non-structural module to one or more of the plurality of volumetric blocks.

2. The method of claim 1, wherein affixing the at least one non-structural module includes affixing the at least one non-structural module to a core volumetric block.

3. The method of claim 1, wherein inserting the at least one non-structural module into the building frame includes moving the at least one non-structural module into place within the building frame and affixing the at least one non-structural module to a volumetric block of the plurality of volumetric blocks.

4. The method of claim 1, wherein the at least one non-structural module is fabricated using a multiple station assembly line.

5. The method of claim 1, wherein the at least one non-structural module comprises one or more of a kitchen accommodation module, a bedroom accommodation module, a living room accommodation module, an office, a conference room and a hospital room.

6. The method of claim 1, wherein the plurality of volumetric blocks comprises one or more of the deck block, a core block, and a foundation block.

7. The method of claim 1, wherein at least one of the plurality of volumetric blocks includes a core block comprising at least one column, at least one deck unit, and at least one stair unit.

8. The method of claim 1, wherein the plurality of deck units comprises a first deck unit, a second deck unit, and a third deck unit, and wherein inserting the at least one non-structural module between two of the plurality of deck units of the deck block comprises inserting a first non-structural module between the first deck unit and the second deck unit, the method further comprising:

inserting a second non-structural module between the second deck unit and the third deck unit.

9. The method of claim 1, wherein the at least one non-structural module comprises one or more of a wall covering, a cabinet, a countertop, a fixture, an appliance, a plumbing fixture, mechanical equipment, and distribution equipment.

10. The method of claim 1, wherein the at least one non-structural module comprises at least one of a sound-rating or a fire-rating.

11. The method of claim 1, wherein the at least one non-structural module further comprises a ceiling.

12. The method of claim 11, wherein fabricating the plurality of pre-fabricated structural units comprises at least one of painting, sound-rating, fire-rating, insulating, electrical wiring, incorporating a duct, and incorporating one or more plumbing features into at least one of said plurality of structural units.

13. The method of claim 1, wherein the at least one non-structural module is divided into at least two rooms by at least one wall.

14. The method of claim 13, wherein affixing the at least one non-structural module to the at least one of the plurality of the volumetric blocks comprises causing the at least one wall dividing the non-structural module into at least two rooms to contact the top of the at least one of the plurality of volumetric blocks.

15. The method of claim 1, the plurality of prefabricated structural units further comprises a stair unit.

16. The method of claim 1, wherein said assembling said plurality of structural units into the plurality of volumetric blocks further comprises at least one of completing an electrical connection between the assembled pre-fabricated structural units, and completing a plumbing connection between the assembled pre-fabricated structural units.

17. The method of claim 1, wherein the at least one non-structural module is fabricated at a first location, wherein the plurality of the pre-fabricated structural units are fabricated at a second location, wherein assembling the plurality of the pre-fabricated structural units into the plurality of volumetric blocks occurs at a third location, wherein assembling the volumetric blocks into the building frame occurs at a fourth location, and wherein said first location, said second location, said third location, and said fourth location are different from one another.

18. The method of claim 1, wherein each of the plurality of deck units comprises a first edge, a second edge, a third edge, and a fourth edge, wherein assembling the deck block comprises affixing the first edge and the second edge of the first edge, the second edge, the third edge, and the fourth edge of each of the plurality of deck units to the one or more columns.

19. The method of claim 18, wherein assembling the plurality of volumetric blocks into the building frame comprises:

inserting the deck block into the building frame so the third edge and the fourth edge of the first edge, the second edge, the third edge, and the fourth edge of each of the plurality of deck units interface with other volumetric blocks of the building frame.

20. The method of claim 1, wherein the deck block is a first deck block, and wherein assembling the plurality of volumetric blocks into the building frame comprises:

placing the first deck block on top of a second deck block of the building frame, the second deck block comprising a second plurality of deck units affixed to a second column.

* * * * *